US011253734B2

(12) United States Patent
Tennison et al.

(10) Patent No.: US 11,253,734 B2
(45) Date of Patent: Feb. 22, 2022

(54) PERSONAL PROTECTION DEVICE USING MONOLITHIC ACTIVATED CARBONS

(71) Applicant: Carbon Tex Limited, Woking (GB)

(72) Inventors: Stephen Robert Tennison, Addlestone (GB); John Tyrer, Rearsby (GB); Mark Giles, Ash Green (GB)

(73) Assignee: Carbon Tex Limited, Woking (GB)

( * ) Notice: Subject to any disclaimer, the term of this patent is extended or adjusted under 35 U.S.C. 154(b) by 516 days.

(21) Appl. No.: 15/525,580

(22) PCT Filed: Nov. 10, 2015

(86) PCT No.: PCT/GB2015/053402

§ 371 (c)(1),
(2) Date: May 9, 2017

(87) PCT Pub. No.: WO2016/075451

PCT Pub. Date: May 19, 2016

(65) Prior Publication Data

US 2017/0333736 A1 Nov. 23, 2017

(30) Foreign Application Priority Data

Nov. 10, 2014 (GB) ..... 1419946

(51) Int. Cl.
*A62B 17/04* (2006.01)
*A62B 19/02* (2006.01)
(Continued)

(52) U.S. Cl.
CPC ..... *A62B 17/04* (2013.01); *A62B 17/006* (2013.01); *A62B 18/04* (2013.01); *A62B 18/08* (2013.01);
(Continued)

(58) Field of Classification Search
CPC ..... A62B 17/04; A62B 17/006; A62B 18/02; A62B 18/025; A62B 18/04; A62B 18/08;
(Continued)

(56) References Cited

U.S. PATENT DOCUMENTS 3,789,839 A * 2/1974 Lund ..... A62B 17/04 128/201.25
4,441,506 A * 4/1984 McCombs ..... A63B 23/18 482/13
(Continued)

FOREIGN PATENT DOCUMENTS

GB 2431114 A 4/2007
WO WO-03/008068 A1 1/2003
(Continued)

OTHER PUBLICATIONS

International Patent Application No. PCT/GB2015/053402, International Preliminary Report on Patentability dated May 26, 2017, 13 pgs.
(Continued)

*Primary Examiner* — Joseph D. Boecker
*Assistant Examiner* — Brian T Khong
(74) *Attorney, Agent, or Firm* — Schwegman Lundberg & Woessner, P.A.

(57) ABSTRACT

A low pressure drop device for personal protection against toxic industrial chemicals and chemical warfare agents has a flexible polymer hood impermeable to toxic challenge molecules, a neck seal for sealing the hood about the neck, a half mask for connection to a canister and a low pressure drop canister for chemical protection. The canister contains carbon monoliths of 5- 40 mm diameter, length 1-3 cm, open area 30-60%, surface area ≥700 $m^2/g$ optionally activated to >30 wt % weight loss and optionally impregnated with metallic additives and/or triethylene diamine. The monoliths
(Continued)

have square channels of size 100-2000 μm and wall thickness 100-2000 μm. It also contains a resiliently flexible closed cell foam with holes slightly smaller than the monoliths so that flow through the canister is through the monoliths.

11 Claims, 15 Drawing Sheets

(51) Int. Cl.

| | |
|---|---|
| ***A62B 19/00*** | (2006.01) |
| ***A62B 17/00*** | (2006.01) |
| ***A62B 18/04*** | (2006.01) |
| ***A62B 18/08*** | (2006.01) |
| ***A62B 23/02*** | (2006.01) |
| ***A62B 7/10*** | (2006.01) |

(52) U.S. Cl.
CPC ..... *A62B 19/00* (2013.01); *A62B 19/02* (2013.01); *A62B 7/10* (2013.01); *A62B 23/02* (2013.01)

(58) Field of Classification Search
CPC ..... A62B 23/00; A62B 23/02; A62B 19/00; A62B 7/10; A61M 16/22; B01D 53/02; B01J 20/0218; B01J 20/0233; B01J 20/024; B01J 20/20; B01J 20/22; B01J 20/28042; B01J 20/28078; B01J 20/28057; B01J 20/28069; B01J 20/32; B01J 2220/42
See application file for complete search history.

(56) References Cited

U.S. PATENT DOCUMENTS 4,856,508 A * 8/1989 Tayebi ..... A62B 23/025 128/206.12
5,003,974 A * 4/1991 Mou ..... A62B 17/04 128/201.25
5,094,616 A * 3/1992 Levenson ..... A61C 17/08 433/93
H1316 H 6/1994 McGuiness
5,419,318 A * 5/1995 Tayebi ..... A41D 13/1146 128/205.27
5,452,712 A * 9/1995 Richardson ..... A62B 17/04 128/201.22
5,625,902 A * 5/1997 Drews ..... A62B 17/04 128/201.23
5,653,225 A * 8/1997 Schegerin ..... A62B 17/04 128/201.22
6,015,041 A * 1/2000 Heung ..... F17C 11/005 206/70
6,134,716 A * 10/2000 Richardson ..... A41D 13/11 2/171.2
6,340,024 B1 * 1/2002 Brookman ..... A62B 17/04 128/201.15
6,517,549 B1 * 2/2003 Dennis ..... A61M 16/0493 606/108
6,670,039 B1 * 12/2003 Nagle ..... C04B 35/573 428/304.4
6,763,835 B1 * 7/2004 Grove ..... A62B 17/04 128/201.25
9,259,031 B2 * 2/2016 Branton ..... A24D 3/163
9,278,170 B2 * 3/2016 Tennison ..... A61M 1/34
2003/0145732 A1 * 8/2003 Leffel ..... F02M 35/02 96/134
2004/0003810 A1 * 1/2004 Templeton ..... A62B 17/04 128/201.22
2004/0259729 A1 * 12/2004 Kaiser ..... B01D 53/02 502/417
2005/0126395 A1 * 6/2005 Blackburn ..... B01D 39/2055 96/108
2005/0193472 A1 * 9/2005 Courtney ..... A62B 17/04 2/202
2005/0247310 A1 * 11/2005 Grove ..... A62B 17/04 128/201.22
2006/0283455 A1 * 12/2006 Walker ..... A41D 13/1153 128/206.24
2006/0289004 A1 * 12/2006 Saez ..... A62B 17/04 128/201.24
2007/0056954 A1 * 3/2007 Tennison ..... H05B 3/145 219/461.1
2013/0001156 A1 * 1/2013 Takeno ..... B01D 61/362 210/497.01
2013/0302231 A1 * 11/2013 Aikens ..... B01J 20/041 423/210
2014/0013942 A1 * 1/2014 Wojtowicz ..... B01J 20/20 95/95
2014/0238392 A1 * 8/2014 Johnston ..... A62B 17/04 128/201.25
2015/0283493 A1 * 10/2015 Billingsley ..... B01J 20/28052 128/205.29

FOREIGN PATENT DOCUMENTS

WO WO-03/074130 A1 9/2003
WO WO-03/099385 A1 12/2003
WO WO-2004/030765 A1 4/2004

OTHER PUBLICATIONS

International Patent Application No. PCT/GB2015/053402, Search Report and Written Opinion dated Apr. 12, 2016, 17 pgs.
Osmond, N.M., et al., "Pressure Drop and Service Life Predictions for Respirator Canisters", American Industrial Hygiene Association, 62 (3), (2001), 288-294.

* cited by examiner showing the nomenclature of a folded membrane

Military Gas Mask

Hood System of Invention

Front view of hood system of the invention

Adsorbent Testing System and monolith mounting system

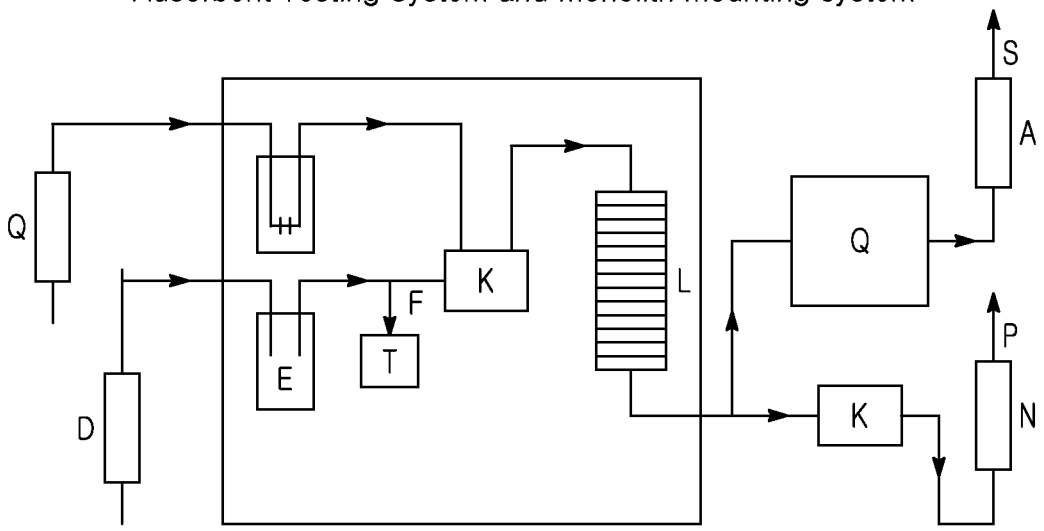

D flow meter for air
E water saturator
F excess of air (not in use in case of sinusoidal flow)
G flow controller for vapour generating branch of airflow
H vapour generating system
K mixing chamber
L filter to be tested
M safety charcoal filter
N breathing machine
P vacuum system
Q analysis of effluent concentration
R flow controller for detection
S vacuum system
T measure of T and RH

FIG. 11A

Shrink wrapped showing monolith

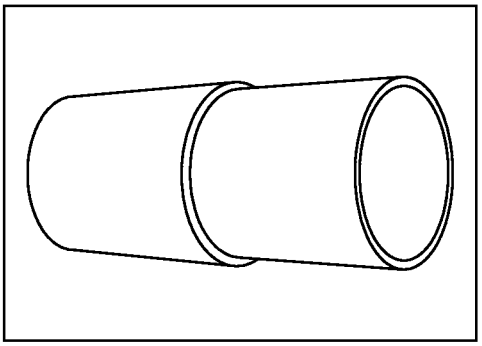

FIG. 11B

Shrink wrapped showing copper tube

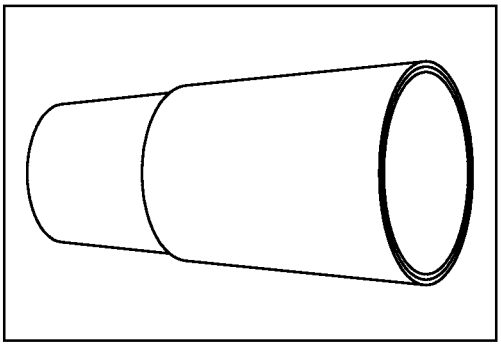

FIG. 11C

PERSONAL PROTECTION DEVICE USING MONOLITHIC ACTIVATED CARBONS

This application is a U.S. National Stage Filing under 35 U.S.C. 371 from International Application No. PCT/GB2015/053402, filed on Nov. 10, 2015, and published as WO 2016/075451 A1 on May 19, 2016, which claims the benefit of priority United Kingdom Patent Application No. 1419946.7, filed on Nov. 10, 2014, each of which is hereby incorporated by reference herein in its entirety.

FIELD OF THE INVENTION

This invention relates to a CBRN personal protection device primarily for use by first responders (police, paramedics, ambulance etc.). However its construction and method of use will also make it usable by a broad spectrum of the general public as well by the security services. The unique design of the filter media will also allow its use in larger applications, such as building protection, where low pressure-drop is also critical.

BACKGROUND TO THE INVENTION

Current personal protection devices as used by the military are characterised by two main components—a mask and canisters—which need to operate together. Military mask systems are typified by the device shown in FIG. 2 which comprises a rubber mask part that contains a visor and inhale-exhale valves and canisters that are either screw or bayonet fitted to the mask. These provide no protection to the head, which remains exposed and which then requires full CBRN clothing. The mask has to provide an effective seal to the face so that inhaled gases only pass via the filters. The canisters are loaded with an adsorbent that at present is always based on granular activated carbon, which provides protection against physically adsorbed species and is impregnated with a range of metals and other components to provide adsorption potential for the chemical challenges. The mask and the canister have to operate together to provide protection.

Gas masks have been in general use by the armed forces since the first use of poison gases in World War One. They have continuously evolved since then to the general service respirators that are in use today and that offer protection against a wide range of chemical and biological challenges as dictated by military demands. For this purpose, they tend to be tested against high concentrations of the challenges that would not be encountered in normal use. These are also designed to be used in conjunction with full CBRN protective suits.

More recently, however, there has been a shift in the CBRN protection requirements following, for instance, the attacks in the Tokyo subway sarin attack of 20 Mar. 1995 and civilian attacks in Iraq and Syria. This leads to a requirement to protect civilian response teams that have to deal with the attacks, injured people that have been the subject of the attacks, and possible large groups of the general public where there is deemed to be a major threat. This leads to very different requirements for the protection device. The nature of the treat means that the actual level of the challenge will probably lower whilst the chemicals that could be used expands to include toxic industrial chemicals (TIC'S) rather than advanced chemical warfare agents. The device will also only be used for restricted period, perhaps 30 minutes, at an intermediate concentration, rather than the longer duration specified in a military environment whilst the challenge levels will tend to be significantly lower.

More significantly, the device will need to be used by a wide range of people rather than the more limited spectrum encountered in the armed forces. A reduction in general fitness means that a much lower pressure drop through the filter system (breathing resistance or burden) will be desirable. The overall device must also be usable by people ranging from 5% to 95% of the average head sizes, performance should not be hampered by facial hair or hair styles, it must be usable be people wearing glasses and it must be easily fitted to injured people. Desirably for ease of use the ultimate design must be "ONE SIZE FITS ALL". There is also a set of operational requirements related to the use by first response teams such as ease of communication, good vision, and ability to carry out complex tasks wearing the device. It should also be light and compact so that it can be routinely carried by first response groups.

A detailed evaluation of the combination of the desiderata outlined above shows that they cannot be met by conventional mask plus canister respirators. These are designed to be worn by service personal and the absence of facial hair, excessive hair and glasses is important for their efficient operation to ensure a good seal to the face. Furthermore they are only applicable to a limited spectrum of head sizes. The military specification (challenge concentration and duration of use of military respirators) also leads to the use of large canisters with correspondingly high pressure drops (burden) that would be unacceptable for use by the general population.

There has been a significant amount of work targeted at the development of reduced burden filters for use in these canisters but these are not used in current generation devices. The canisters in use today are still restricted to simple packed bed systems, or sometimes immobilised granular systems to eliminate packing problems, and where relatively large particle sizes have to be used to reduce the pressure drop. This larger grain size then limits the performance of the beds which is characterised by the critical bed depth which shows the bed depth at which instantaneous break through would occur. The operational bed depth then needs to be significantly larger to give the required operational time. This leads to beds that are at least 2 cm deep. A key requirement then is to devise an adsorbent system that can reduce pressure drop.

The adsorbents used in the military canisters have also evolved over time to the most widely used current copper/tungsten/silver/zinc—TEDA formulation supported on granular activated carbon that is required to meet the wide variety of challenges. There is a very large body of work in both the scientific and patent literature on the optimisation of preparative methods. For safety reasons tungsten is now being replaced with molybdenum and this will almost certainly be required for a system to be used outside of the military. The carbon used in these canisters is typically either a coal or coconut shell-based activated carbon with a BET surface area of >1000 $m^2/g$. Nonetheless the existing systems still cannot easily deal with both acid and basic gases using a single impregnated carbon.

A canister system must meet the low burden requirement and the adsorption requirements for the full range of challenges whilst being small enough to meet the operational requirements of being lightweight, compact and easily packaged The only solution other than the mask approach for the overall device is to use a hood and this approach has been quite widely evaluated. There are several devices available on the market—none of which meets the key design specifications for our target markets. These range from simple plastic bags with very crude closure systems, which are probably very dangerous to the wearer, to sophisticated devices that cannot meet the cost requirements. For most of these devices a critical omission is "one size fits all" as the more advanced devices generally use a neoprene neck seal which cannot accommodate the full range of neck sizes or the requirement for ease of application to injured people. The most recent device, marketed by Elmbridge protection, is claimed to be one size fits all, but is only marketed as a smoke/fire protection device and utilises large conventional filters that would impose a significant burden. It is also unlikely to meet the full spectrum of chemical defence challenges.

The overall desiderata that should then be met are

Duration—30 minutes minimum, Dealing with TIC's (toxic industrial chemicals)/TIM's/biological challenges Neck Size, "one size fits all" for both the first responders and injured people. The target should be neck sizes from 30 cm to 50 cm and from 12 years old upwards.

It should take account of those wearing glasses and differing hair styles in the first responders Re-breathing—the device should not require either a mouth-piece or nose clip to bring $CO_2$ re-breathing to the acceptable level.

Should be able to be fitted to an unconscious victim

Pressure drop—a key goal of the project is to produce a low burden device. Inhalation 8 mbar (800 Pa), exhalation 3 mbar(300 Pa))

"Acceptable" cost.

These requirements must be met in combination with a range of usability criteria such as ability to communicate and acceptable levels of heat stress. At this point, there is no device that meets all the design constraints, especially at a cost that is realistic for the first response and general public utilization.

SUMMARY OF THE INVENTION

In one aspect the invention provides a universal, low pressure drop personal protection device for providing at least 30 minutes duration protection against a wide range of toxic industrial chemicals and chemical warfare agents and capable of being worn by at least 95% of the population. It can be easily put on and can also be easily applied to injured or unconscious people. The device comprises a flexible polymeric hood providing a specially configured neck seal that allows the universal fitment, a half mask to provide the method of connection to the canister and a very low pressure drop canister system that provides the chemical protection The hood can additionally include a window made from a semi-rigid transparent polymer to enhance vision that can also be treated on the inside to reduce condensation. The exceptional performance of the system derives from the combination of the hood, half mask and canister where the very low pressure drop of the canister permits the effective use of the seal systems incorporated into the hood.

The invention further provides a hood system comprising a flexible polymeric bag where the polymer is selected to be impermeable to the toxic challenge molecules combined with a half mask to which the canister is attached. The polymer must be thin enough that when folded around the neck and held in place by a strap the folds are sufficiently compact to provide a good seal. The overall seal derives from a combination of the primary seal provided by the folded polymer and the secondary seal between the face and the half mask. This is only effective in conjunction with the low pressure drop canister which also prevents leakage of carbon dioxide past the half mask seal and re-breathing of carbon dioxide during exhale and inhale The polymer from which the bag is made should be less than 0.1 mm thick , preferably less than 0.015 mm. This can be achieved if either the entire bag is produced from the thin polymeric material or the majority of the bag is made from a thicker polymer with enhanced flexibility and strength with a band of the thinner polymer to give the neck seal. The half mask can be any commercially available system where the construction facilitates the attachment of the bag to the mask and where the retaining straps assist in collapsing the hood around the head to minimise dead volume The invention also provides a canister system e.g. for use in the above device which comprises monolithic activated carbons impregnated with materials selected from metallic additives and triethylene diamine according to the anticipated challenge and well known to those skilled in the art. The composition typically comprises copper, molybdenum , silver , zinc and triethylene diamine where the loadings of the individual components can be adjusted to reflect the expected use. The monoliths which may be between 5 and 40 mm diameter, preferably 15 to 30 mm, are mounted into the canister using a closed cell foam or similar flexible polymeric material that forces the flow of the challenge gases through the monolithic structures. An embodiment of the canister also includes a distributor plate that ensures an even distribution of the incoming gas stream to all of the monoliths. The method of mounting allows the use of any shape of canister and can also be adapted to allow the adsorbent system to be mounted into a helmet or chin strap.

Activated carbon monoliths according to the invention may be the result of:

(a) partially curing a phenolic resin to a solid;

(b) commenting the partially cured resin; extruding the comminute resin;

(c) sintering the extruded resin so as to produce a form-stable sintered product;

(d) carbonising the form stable monolithic structure in lengths of 10 to 100 cm, preferably 10 to 30 cm, in an inert purge gas at a temperature of 700 to 800° C.

(e) Cutting the carbonised monoliths to a length of between 10 and 50 mm, preferably 20-30 mm (f) Activating the cut monolithic sections in flowing carbon dioxide at a temperature from 850 to 950° C. where the time is selected to give a level of activation of between 20 and 50%, preferably 30-40%.

Data on the monoliths in impregnated form has not been published heretofore.

Embodiments have been impregnated with Cu/Zn/Mo/Ag—TEDA which is a standard material for chemical defence applications although it can be modified for more specific challenges. The total metal loading is as described below. These impregnants are specifically required for the warfare agents e.g. HCN, $CNCl_2$, Phosgene, and acid and base gases—$NH_3$ and $SO_2$. There are two aspects to the performance:

(a) The ability to trap both acid and basic gases and to render the warfare agents inactive with good efficiency (b) The ability to efficiently adsorb vapours (physical) in the presence of the impregnants required for chemical trapping.

(b) is particularly significant as in a conventional activated carbon the metals/TEDA tend to at least in part infiltrate the micro pores where the physical adsorption takes place and to then inhibit the physical vapour adsorption. Without being bound by this we believe that in the monoliths the metals tend to accumulate in the inter-granular space created by the sintered resin particles in the monolith walls and also perhaps in the monolith channels, leaving the micropores within the primary particles free to carry out the physical adsorption.

The BET surface area of the activated monoliths may be greater than 1000 $m^2/g$, preferably greater than 1200 $m^2/g$ The invention also provides a method of impregnating the monoliths which preferably comprises the successive steps of:

adding all of the metallic components simultaneously from a mixed ammoniacal solution of the metallic precursors by a dip and drain procedure including evacuation and re-pressurisation to fill the monolith pore structure;

removal of excess solution by blowing through the channels;

baking the monoliths to convert the compounds to oxides; and optionally a second impregnation can be carried out if desired.

To facilitate the process the monolith can be mounted in a closed cell foam holder during the impregnation and blowing.

In a further aspect, of the invention provides a method of mounting the monoliths into the canister or other containment device which comprises a flexible, closed cell foam with holes slightly smaller than the size of the impregnated monoliths, in which the monoliths are simply pressed into the holes. The number and distribution of the holes and monoliths can be adjusted to give a required canister shape and overall weight of adsorbent. The approach allows the production of a canister of any shape and optionally one that can be curved to suite the shape of the face or location of mounting, for instance on a helmet. This avoids all of the problems associated with packing granular materials into odd shaped or curved housings. A perforated plate may be incorporated into the canister that allows the gas to be evenly distributed through all of the monoliths by varying the number and distribution of the holes in the perforated plate, and that makes a negligible contribution to the overall pressure drop of the canister.

A further aspect of this invention relates to the way the monoliths are mounted in the canisters. This can be seen from FIG. 20. The method of production of the monoliths is not easily adapted to large sizes and non-circular shapes consistent with conventional canister formats. To overcome this we have shown that smaller monolith segments (a) can be readily mounted into a closed cell foam (b) which can then be mounted into the canister structure (c). Five of the six monolith segments (a) are shown inserted into the foam (b) and an aperture (d) in the foam is shown ready for insertion of the sixth monolith segment. The compression of the foam during closure of the canister structure then ensures a good seal between the monoliths and the foam and the foam and the canister. The benefit of this method of assembly is that the shape and size of the canister can be very simply changed without changing the monolith dimensions.

It is also possible using this foam mounted approach to produce a curved structure (d) that can conform to the shape of the face or where the adsorbent could be fitted for instance into a chin strap or helmet. The method of construction can also be extended to much larger filters, for instance those used in building air conditioning or to large radial flow filters such as those more commonly used in ships or buildings.

This method of assembly also simplifies manufacturing as achieving a uniform packing density in curved or non-circular filter assemblies is very difficult. Production is also cleaner and safer as it avoids the dust associated with handling of granular materials.

The very low pressure drop of these monolith based systems also then allows additional modifications to the canister design. Whilst reasonable flow distributions can be achieved in circular canister this is considerably more difficult in asymmetric or non-circular designs. With the foam mounted monoliths it is possible to incorporate a flow distributor plate to channel gas flow to the extremities of the canister. In its simplest form this can be a plate with holes located below the monolith centre points where the holes generate a small additional pressure drop that channels the gas to the required locations.

BRIEF DESCRIPTION OF THE DRAWINGS

Various embodiments of the invention will now be described, by way of example only, with reference to the accompanying drawings, in which:

FIG. 11A is a block diagram of an adsorbent testing system and a monolith mounting system and FIGS. 11B and 11C are respectively shrink-wrapping showing a monolith and shrink-wrapping showing a copper tube;

DETAILED DESCRIPTION OF THE PREFERRED EMBODIMENTS

We have now found that the above requirements can be met through a synergistic combination of a novel hood design combined with a novel canister design. The combination of the two elements is critical as the hood design can only neck seal if it is thin enough it will fold and form closed pleats (4) that provide a gas tight but flexible seal around the neck that can then be easily closed using a user reconfigurable simple hook and loop fastening band (5). The entry to the bag can then be big enough to cope with all sizes of head and hair styles whilst still closing effectively around all neck sizes. This neck seal then provides the primary seal against ingress of chemical agents whilst the facelet seal provides secondary protection. The facelet seal is not then required to provide the primary seal in the case of people with facial hair. The use of a low pressure canister considerably aids the performance of this structure as it minimises any tendency for bypassing around the neck and face seal during inhale and for $CO_2$ leakage into the bag during exhale.

The entire hood can be made from the thin plastic that is essential to achieve the correct neck seal or the main hood can be produced from a thicker plastic with a collar of the thin plastic required for the seal. Preferably for use by the emergency services the main bag is made from a soft flexible plastic that minimises noise generation when the head is moved to aid communication. However this is not critical for injured people or when being used by the general public for escape purposes.

The facelet is held in place by the head cap which has the additional function of collapsing the bag around the head minimising free volume. This is a desirable property to prevent carbon dioxide rebreathing as some carbon dioxide can escape past the facelet into the main body of the bag. There is a further strap from the facelet that passes around the neck. This ensures that the facelet is held reasonably firmly against the face and minimises bypassing.

Figure 5:
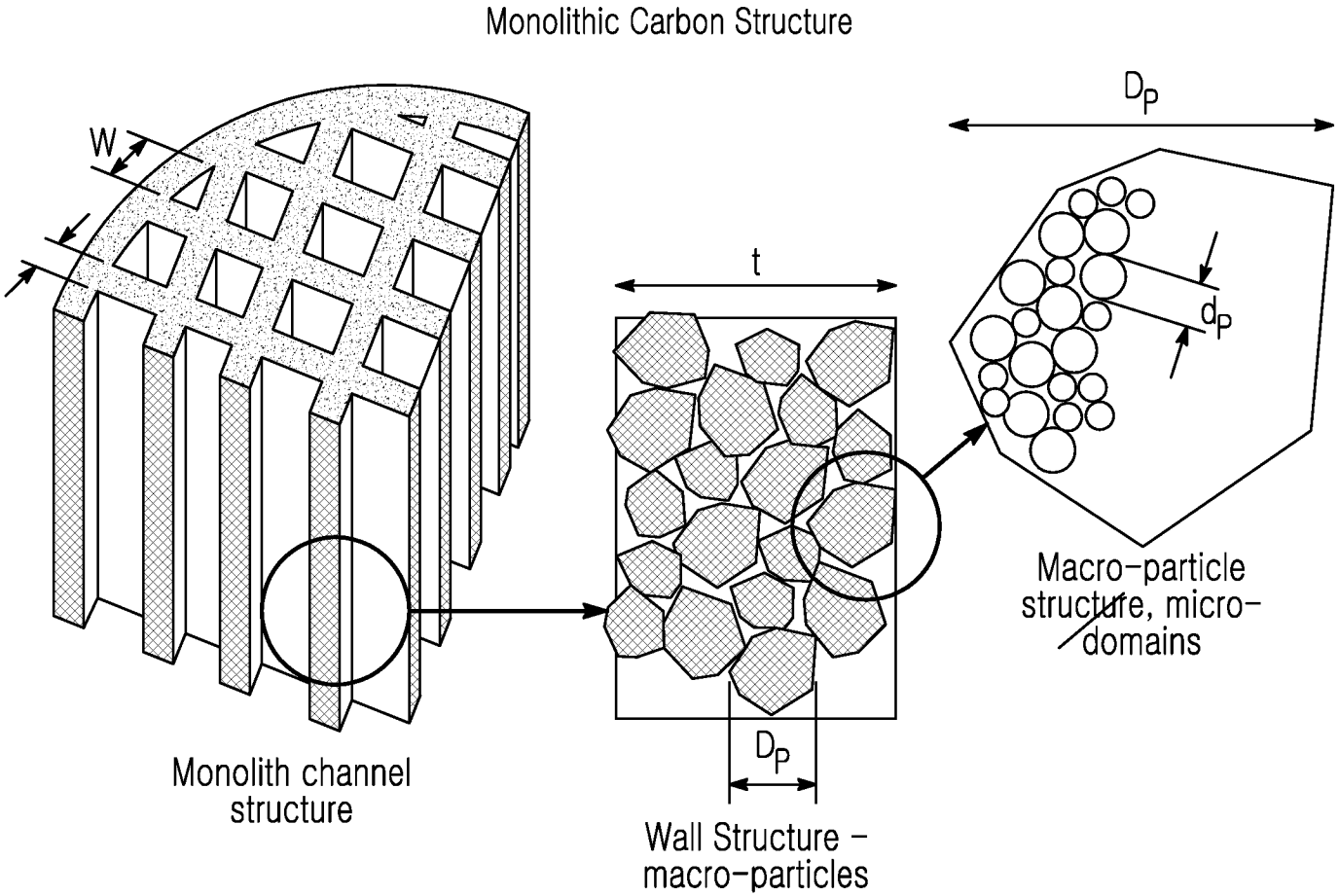
FIG. 5 is a view of part of a carbon monolith showing channels, wall structure and structure of a macro-particle forming part of a channel wall.

The canisters are attached to the facelet either by a screw fitting, a bayonet fitting or can be permanently fixed if the device is only intended for single use. It is not anticipated that the canisters will be replaced with the hood in use. There can be either one or two canisters depending on the performance required. Preferably there are two. The most critical aspect of the canisters is the use of monolithic carbon adsorbents as shown in FIG. 5.

The production and use of these in longer lengths has been described in U.S. Pat. No. 6,964,695 for organic vapour control in industrial facilities and this is incorporated by reference herein. Their use in canister systems has also been described in U.S. 2005/126395A1 and is also incorporated herein but this also used monoliths with a long L/D which was thought necessary to achieve the required break through characteristics and which restricted the design of the canisters. These applications were also based on the use of un-impregnated carbon for use with only absorbable vapours.

We have now surprisingly found that by careful optimisation of the cell geometry (wall thickness, channel size and cell density), the structure of the carbon comprising the walls of the monoliths and the degree of activation, that these monoliths can be used in very short lengths, 10-30 mm e.g. 15-25 mm, consistent with the design of the canisters for use in the current device. This gives excellent breakthrough characteristics when used as pure carbon for adsorbing cyclohexane. Even more surprisingly, when impregnated with the high loadings of metals and TEDA required to give performance against chemical agents such as cyanide, ammonia and sulphur dioxide, this had little impact on the capacity for cyclohexane and very little impact on the critical bed depth so that there was no specific requirement to increase the length or quantity of the monoliths.

Hood Assembly

The wearer of the hood may not have received training in the application and use of such a protective device. The system is expected to be rapidly deployed not only for the wearer but also be fitted by the wearer to third parties who may be injured and even unconscious. The likely wearer of such a hood will be of either gender across the full age/size spectrum and may have copious amounts of hair as well as facial hair. Therefore the hood must cope with a broad spectrum of potential wearers and because of the likelihood of injury, the burden of wearing the system i.e. the breathing resistance, field of view, auditability etc. must be low. The challenging nature of the broad range of requirements meant that careful consideration was given to the ergonomic demands put upon the design such that it could accommodate issues such as an unconscious person waking up wearing a hood could include claustrophobia, having to don the hood whilst wearing glasses, and somebody having to don the hood having no previous training or experience.

The hood is broken down into four main components; the hood, the facelet/respirator, filter pack and neck seal. All components are to be able to tolerate a broad spectrum of toxic industrial chemicals and materials (TICs & TIMs).

Hood Material

To minimise the psychological impact of wearing a hood e.g. Claustrophobia, the bag material can be made transparent and without colour tint. Polyethylene Terephthalate (PET) is one such reasonable robust clear impermeable membrane material with hypo-allergenic properties and low cost. PET/polyester material is a food safe film that is specially designed for use in high temperatures for an extended period of time, the material is a thermally stable polymer that will withstand a temperature of 230° C. for over one hour thirty minutes without any degradation taking place. It is available in a range of film thicknesses, starting at 12.5 μm, 20, 30, 40-100 μm etc. It is readily available in sheet form or manufactured into a bag. Other similar materials are available. If a more rigid faceplate/visor is required this can be incorporated/bonded into the bag, which may be initially modified with an appropriate aperture cut into one side of the bag. The size of the visor can be chosen such that it extends below the vision area and has an aperture that is suitable for mounting a facelet/respirator. The thickness of the visor is chosen to withstand creasing during manufacture, packaging, unwrapping, application and wearing. Such protection is usually afforded with a thickness greater than 100 μm. The visor can be made of a different material such as polyvinyl chloride.

Facelet/Respirator

Half face masks which incorporate air purifying filters are widely available and well understood. They comprise of a moulded flexible body onto which can be attached filter canisters, valves for the separate ingress and egress of breath and strapping to hold the body to the wearer's head. The moulded body is designed such that it encloses the wearer's nose and mouth. The facelet may be derived from commercially available products, for example a half mask available under the trade name TRADESMAN 2 from JSP of Oxford, England or an OLYMPUS Midimask twin filter mask available from the same source. in both cases the twin filter cartridges conventionally used are replaced by canisters according to the invention.

Sealing of the body to the wearers face is usually accomplished with a soft compliant material which copes with the individual's face topography. Such a respirator can be put into a hood if suitable apertures are made to allow the filters to be attached to the respirator body from the outside of the bag as well as suitable corresponding apertures for the inlet and exhaust valve. Suitable bonding can be incorporated between the mating surfaces of the outer surface of the respirator body and the inner surface of the bag. Such bonding can either be double sided adhesive tape or a suitable interfacial adhesive. The strapping is in general an integral part of the facelet and does not require to be attached to bag. These straps help locate the sides of the bag at appropriate positions on the head of the wearer.

Figure 1:
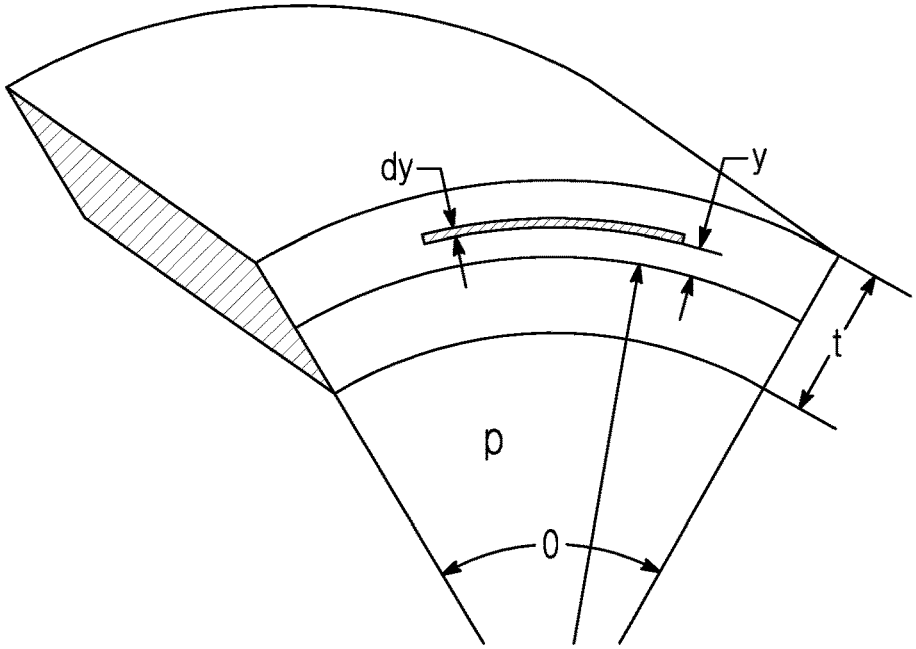
FIG. 1 is a view of a folded membrane showing nomenclature.
Figure 2:
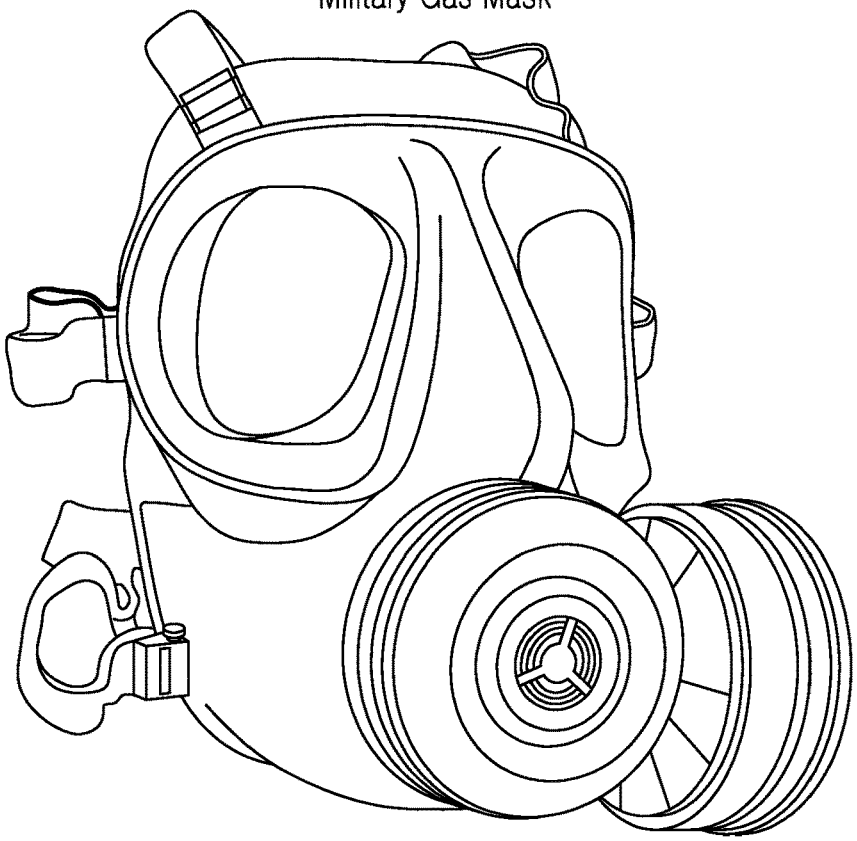
FIG. 2 is a front view of a military gas mask.
Figure 3A:
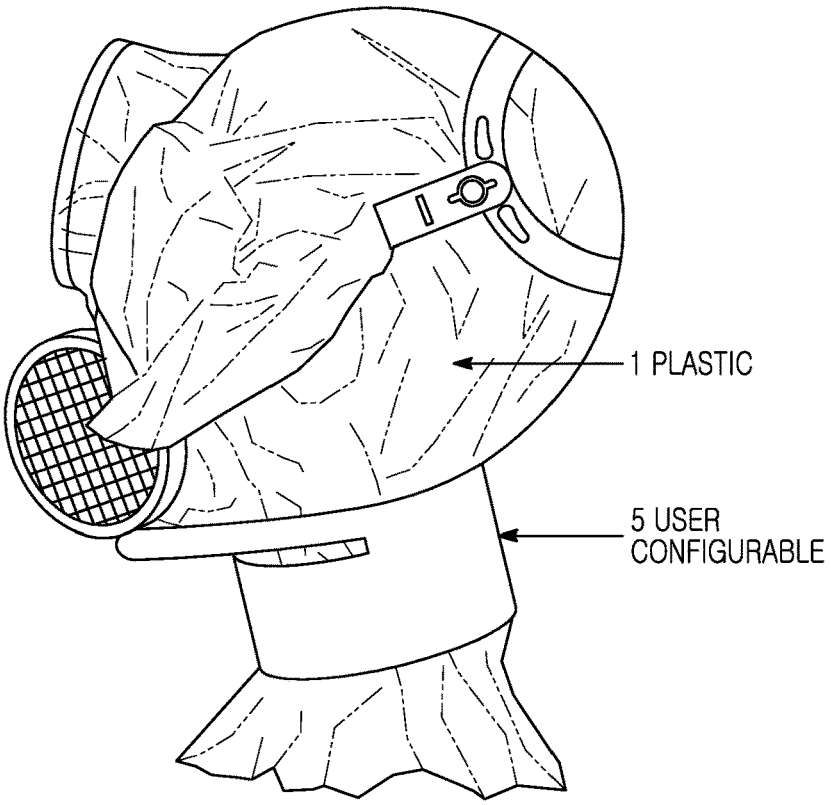
FIGS. 3A and 3B are views from towards the rear and from towards the front of a hood system according to the invention.
Figure 3B:
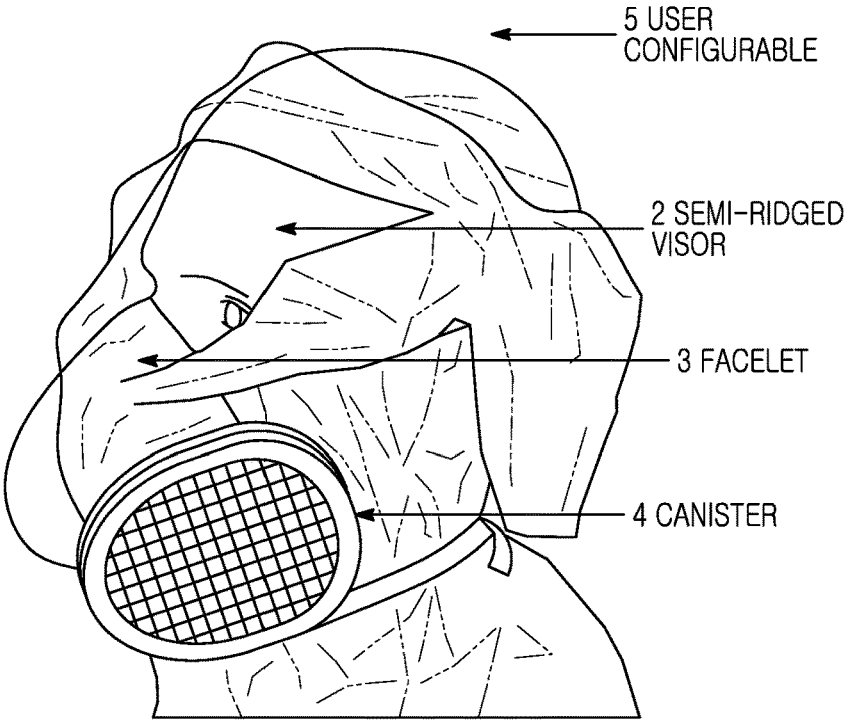
Figure 4:
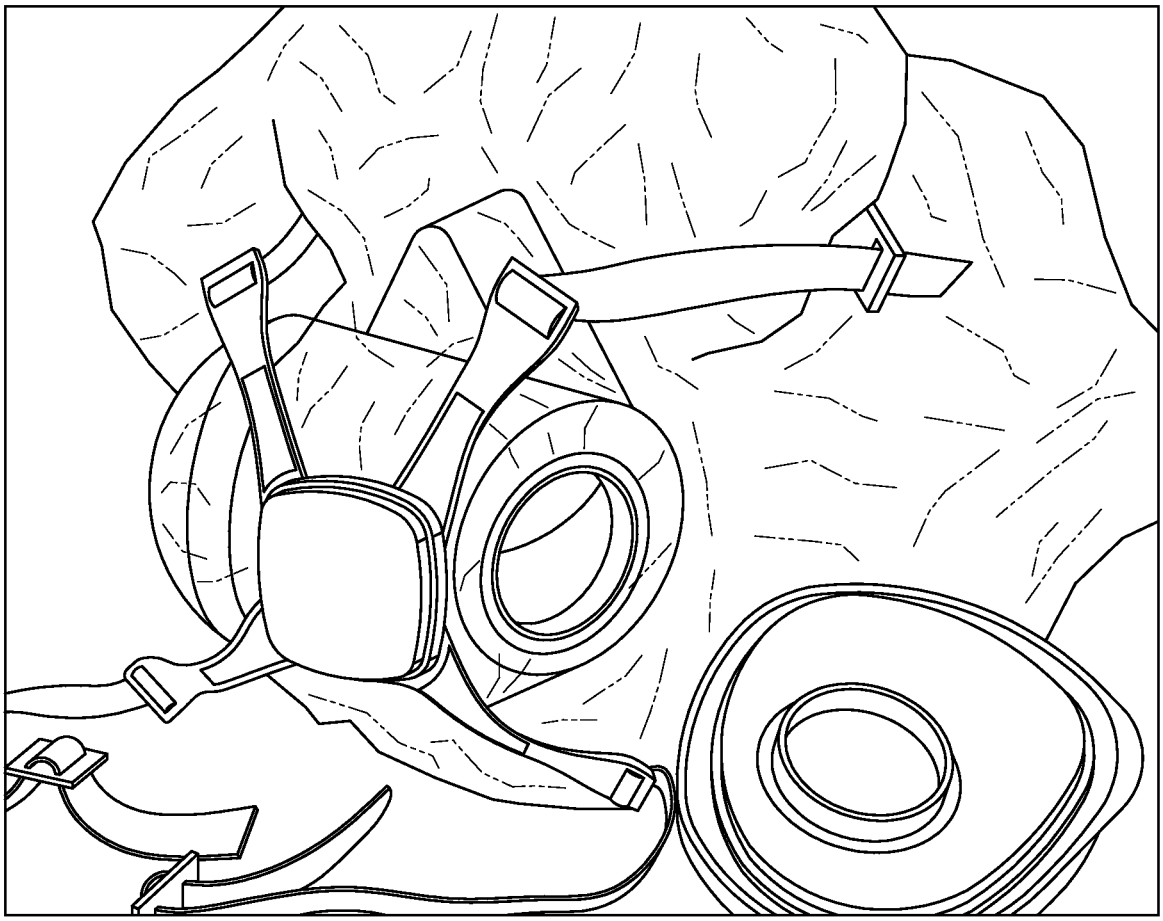
FIG. 4 is a front view of the hood system.

In FIG. 4 which is a view of the front of an embodiment of the hood with one of the canisters removed, the facelet is visible inside the bag 1 and also a hole in the bag where the canister 4 attaches, in this embodiment via a bayonet fitting 8. The inhale-exhale valve 9 can be seen outside the hood-defining bag and this has the straps attached to these are directly connected to the facelet but outside the bag. This means that when the hood is put on and the head straps 10, visible in the picture, are pulled over the head they help to collapse the bag around the head. The bag is apertured for a single canister facelet or in the is embodiment for a dual canister facelet, it is located between the cup of the facelet and the canisters and inhale/exhale valve and is fluid-tightly secured to the cup around apertures for the inhale/exhale valve and the or each canister. Securement may in some embodiments employ adhesive. However, in some embodiments around the canisters and the inhale/exhale valve there is a heavier duty more rigid plastic sheet that is used to make a compression seal to the cup of the facelet. This was desirable as thinner plastic sheet that the hood is made of would not seal properly. This thicker less flexible plastic sheet can seal directly without sealant. Preferably, however, a small bead of a flexible sealant, not a glue, similar to a bathroom silicone sealant can, be used to ensure a more complete seal when the components are fastened together. This more rigid piece of plastic can then be fixed to the flexible hood using double sided tape for instance the 3 M Company adhesive tape.

Filter Pack

The low burden carbon monolith filters can be incorporated within a foam carrier with other filter materials inside a suitable filter housing. A filter body can then be attached to the respirator body with the bag membrane forming a gasket between the two mating surfaces. The hood is designed to be disposed of after use and no reuse is intended. Therefore it is expected that the filters will remain fixed in place once attached.

Neck Seal

Simple aperture elastomeric seals do not cope with the full range of likely wearer neck size ranges. Compression springs provided uniform compliant closure able to cope with rotation and tilt of head, however failed to provide a simple means of ensuring a uniform seal under the neck size range and facial hair constraints.

A solution was devised which comprised of a gathered and compressed seal retained with an adjustable elasticated strap around the wearers neck.

To appreciate the means of providing a hygienic and flexible seal it is necessary to consider how material folds.

Plastic bending occurs when an applied moment causes the outside layers of a cross-section to exceed the material's yield strength. Loaded with only a moment, the peak bending stresses occurs at the outside elements of a cross-section. The cross-section will not yield simultaneously through the section. Rather, outside regions will yield first, redistributing stress and delaying failure beyond what would be predicted by elastic analytical methods. The stress distribution from the neutral axis is the same as the shape of the stress-strain curve of the material (this assumes a non-composite cross-section). After a structural member reaches a sufficiently high condition of plastic bending, it acts as a Plastic hinge.

Elementary Elastic Bending theory requires that bending stress varies linearly with distance from the neutral axis, but plastic bending shows a more accurate and complex stress distribution. The yielded areas of the cross-section will vary somewhere between the yield and ultimate strength of the material. In the elastic region of the cross-section, the stress distribution varies linearly from the neutral axis to the beginning of the yielded area. Not every area of the cross-section will have exceeded the yield strength. The plastic bending force and energy required to permanently fold the sheet to produce a given pattern is derived from the plastic work involved in the bending these flat elements around the element edges to a given permanent angle that corresponded to initial folding angle of the sheet, hence, for bending a sheet of thickness t to a radius of curvature r the strain at a distance y from the neutral plane is given by $$\varepsilon = \frac{y}{\rho} \text{ where } \frac{1}{\rho}$$

is the curvature of the elastic curve of the deflected sheet

The bending moment at this cross section of the sheet is given by M=∫σ yl dy assuming elastic/plastic sheet material then the bending moment, M on the element edge of a length 1 is given by:

$$M = \int_{-t/2}^{+t/2} \sigma y dy = \int_0^{y_y} \sigma y dy + \int_{y_y}^{t/2} y dy \text{ where } \varepsilon_y = \frac{y_y}{\rho}$$

is the limiting elastic strain since the stress in the elastic portion of the bent cross sections given by $$\sigma = \frac{Ey}{\rho},$$

where E is the material Youngs modulus, then $$M = \frac{2}{3} l \frac{E}{\rho} y_y^3 + l\sigma_y \left( \frac{t_4^2}{4} - y_y^2 \right) \text{ since } y_y = \frac{\sigma_{y\rho}}{E} \text{ then}$$

-continued $$M = \frac{lt^3}{4}\sigma_y - \frac{1}{3}l\sigma_y^3\frac{\rho^2}{E^2}$$

and bend curvature is given by $$\frac{1}{\rho} = \sqrt{\frac{\frac{1}{3}\frac{l\sigma_y^3}{E^2}}{\frac{1}{4}lt^2\sigma_y - M}}$$

when the M is removed what will be spring back $$\frac{1}{\rho_{res}} = \sqrt{\frac{\frac{1}{3}\frac{l\sigma_y^3}{E^2}}{\frac{1}{4}lt^2\sigma_y - M}} - \frac{12M}{Et^3l}$$

The impact of folding stress analysis on the neck seal design is that some form of continuous closure is necessary on the fold to stop the spring back of the outer surface. Such a closure can be delivered by a pre-tensioned elasticated strap put around the neck seal which will gather all of the bag material together around the wearer's neck.

The thinner the membrane the better the folding strain levels. At the limit an infinitely thin membrane would fold completely back on itself, which would contain a small retained fillet/gap unless some mechanical compressive force is applied to generate a crease and collapse the fillet/gap leading to near intimate contact between the surfaces at the crease. With increasing membrane thickness a corresponding increasing compressive force will be needed to generate the crease. A thin membrane say less than 100 μm, will crease under the applied compressive load of an elasticated strap secured around the wearer's neck. Slight pre-tensioning of the strap prior to compacting the mating surfaces of the hook and loop materials, will provide continuous compressive stress on the creases. This continuous pressure will maintain the stress necessary to ensure there is no opportunity for spring back of the crease. The pretension in the elasticated strap does not need to be so tight as to cause asphyxiation or blood flow reduction to the wearer.

The use of a hook and loop fastener (e.g., VELCRO ) is to provide an intuitive opportunity to reapply the tension on the strap if required. individuals will recognise the fact that the hook and loop material can be separated to remake the seal if not correctly pre-tensioned at the first attempt. Adhesive materials may not provide such an intuitive reaction and may also lead to local tearing of the membrane which may fail the protection offered by the membrane bag. Local compression of the skin tissue immediately below the membrane material will provide some compliance of the skin into the local surface topography of the membrane surfaces adjacent to the crease. The collection of the bag material around the neck by the hook and loop elasticated strap will mostly be in an axis parallel with the wearers neck column. The membrane material is chosen to provide little if any permeability to gases and liquids. Therefore, the water vapour released by the wearer's neck and head, enclosed by the bag, will condense upon the inside surface of the bag membrane. Some of the condensate will accumulate around the inside of edge of the seal generated by the neck strap om the bag membrane closed around the wearers neck. This accumulating reservoir of condensed sweat around the inside edge of the next seal will provide further filling of any small gaps, generated within the creases, by capillary cation. This provides further protection for the next seal and is also useful during any relative tissue/membrane movement caused by the wearer when moving their head and neck.

Production of Monolithic Forms

By "monolithic" is meant that the porous carbon is in a single piece i.e. not granular or not composed of granular carbons bound together by a binder etc. The monolithic carbon contains large transport channels and the overall structure can be seen by reference to FIG. 5. For a symmetrical monolith a continuous channel structure is defined by a channel dimension, W, and a wall thickness, t, or for an asymmetric monolith by channel length and width or other relevant dimensions as well as wall thickness t. These fix the ratio of open to closed area and therefore the flow velocity along the channels of the monolith. The walls of the monolithic carbon have a macroporous structure formed by the voids between the sintered particles of size $D_P$. This provides interconnected access pores with a mean size equivalent to approximately 20% of $D_P$. The microstructure is contained within the primary particles and comprises sintered nanodomains that are formed during the resin curing process. It is believed that the micropores (<2 nm) are formed primarily by the interconnected voids between these sintered nanodomains ($d_P$ or around 10 nm)

Known methods for the production of complex shaped controlled porosity adsorbent material are discussed in US 2005/126395A1 Blackburn and Tennison), the disclosure of which is incorporated herein by reference. The inventors explain that there are very few viable routes for the production of complex shaped controlled porosity adsorbent materials with good mechanical properties. For instance, they explain that activated carbon is traditionally produced by taking a char, made by pyrolysing an organic precursor or coal, grinding the char to a fine powder, mixing this with a binder, typically pitch, and extruding or pressing to give a "green" body. The green body is then further fired to pyrolyse the binder and this is then typically further activated in steam, carbon dioxide or mixtures of these gases to give the high surface activated carbon product. The drawback to this route is that the binder, which is usually a thermoplastic material, goes through a melting transition prior to pyrolytic decomposition. At this point the material is weak and unable to support a complex form. This, combined with the problems of activating the fired body, limits the size and shape of the products to typically simple extrudates.

An alternative route is to take an activated carbon powder and form this directly into the final shape. In this instance a range of polymeric binders have been used that remain in the final product. The main drawback to this route is that high levels of binders are required and these then tend to both fill the pores of the activated carbon powder and encapsulate the powder leading to a marked reduction in adsorption capacity and deterioration in the adsorption kinetics. The presence of the polymeric phase also degrades the physical and chemical stability of the formed material, severely limiting the range of applicability. A further alternative is to take a formed ceramic material, such as a multichannel monolith, and to coat this with a carbon forming precursor such as a phenolic resin; this can then be fired and activated to produce a ceramic-carbon composite. The main limitations of this route are the cost associated with the ceramic substrate and the relatively low volume loading of carbon.

In the current embodiments carbonised and activated sintered carbons are now formed from phenolic resin precursors. Sintered porous carbon can be made by partially curing a phenolic resin to a solid, comminuting the partially cured resin, forming the comminuted resin into a dough using water and additives well known to those skilled in the art of extrusion, and then carbonising and activating the form-stable sintered resin product. EP 0 254 551 gives details of methods of production the porous resins suitable for forming the porous carbon used in the present invention and its contents are included herein by reference. US 2004/045438A1 (Place et al) the disclosure of which is incorporated herein by reference) gives details of producing monolithic structures using the sintered resin structures.

In the standard process, the resin cure is controlled through a combination of the temperature, time and concentration of the cross linking agent, preferably hexamethylene tetramine (HEX) so that it is sufficient to prevent the resin melting during subsequent carbonisation but low enough that the particles produced during the milling step can sinter during subsequent processing. The temperature, duration of the partial curing step and amount of curing agent are selected as to give a degree of cure sufficient to give a sinterable product.

By "sintering" we mean a step which causes the individual particles of phenolic resin to adhere together without the need for a separately introduced binder, while retaining their individual identity to a substantial extent on heating to carbonisation temperatures. Thus the particles must not melt after forming so as to produce a molten or deformable mass of resin, as this would reduce or eliminate the internal open porosity of the article. The open porosity (as opposed to the closed cells found in certain types of polymer foams) is important in enabling formed particles to retain their shape on carbonisation.

The degree of cure can be measured using acetone extraction. In this method a sample of the milled cured resin is sieved to a size range of 125 μm to 250 μm, A 6 g sample is placed in a Soxhlet thimble and uncured or low cured resin is extracted with acetone under reflux. After 7 hours the thimble is removed and dried and the loss in weight is determined. The percentage of acetone extractable resin should be in the range 5 to 15% weight. A higher weight of extractable resin will lead to distortion in the subsequent process steps whilst an extractable content below 5% wt will lead to a reduction in the mechanical properties of the formed carbon In one embodiment the comminuted resin particles have a particle size of 1-250 μm, more preferably 10-70 μm. Preferably the resin powder size is 20-50 μm which provides for a macropore size of 4-10 μm with a macropore volume of around 40%. The size of the particles is selected to provide a balance between diffusivity through the interparticle voids and within the particles. We have also found that it is critical to have precise control over the particle size distribution of the resin powder used in the extrusion process. After jet milling the resin tends to comprise a bimodal distribution with a significant concentration of smaller particles. This is shown in FIG. 4 where the material, jet milled to a primary particle size of 40 microns, has a significant secondary peak at <20 microns. We have now found that whilst this material can be readily extruded the presence of the finer powder tends to infill the voids between the larger particles. This inhibits both the carbonisation and activation process and can lead to cracking. Conversely, if the fines are removed by classification, the carbonisation and activation of the monoliths is facilitated but extrusion becomes more difficult. We have now found that adding back adding approximately 5-10% weight of the fines removed by classification can provide a material that has optimum extrusion, carbonisation and activation properties.

As disclosed in US 2004/045438A1 the milled powder can then be extruded to produce polymeric structures with a wide range of physical forms and cell structures, limited only by the ability to produce the required extrusion die. These can range from relatively simple "spaghetti" forms up to and including trilobe and quadralobe structures along with for instance RASCHIG rings. In a further level of complexity, the resin can be extruded to form square channel monoliths. At this stage the monolith has a bimodal structure—the visible channel structure with either the central channel in a simple tube or the open cells in a sequence channel monolith of 100-1000 μm cell dimension and cell walls with thickness 100-1000 μm and the macropore structure within walls generated by the sintered resin particles.

The walls of the sintered carbon have a macroporous structure. By "macroporous" is meant that the carbon has continuous voids or pores. The macropore structure in the walls is controlled by the particles used to form the structure. When the structure is made from macro-particles with a mean particle size of $D_p$ the macropore size is typically 20% of the size of the precursor resin particles. In the square channel monoliths the particle size can be varied over a wide range from a maximum particle size of approximately 10% of the wall thickness, t, to a minimum practical particle size of about 10 μm. This gives a macropore size of 2-20 μm within the wall for a 1 mm wall thickness. For the simpler "spaghetti" structures a wider range of particle sizes is possible. The pore size fixes the diffusivity of the adsorbate molecules within the matrix. In the current embodiments the monoliths are square channel monoliths with a cell structure (cells per square cm) where the channel size is between 100 and 2000 μm, preferably 400-800 microns, and the wall thickness is preferably between 400 and 800 μm and with an open area of between 30 and 60%, preferably 30-40%, to give a good carbon packing density per unit volume and acceptable mass transfer and pressure drop characteristics. This equates to a cell density of between 400 and 1200 cells per square inch, preferably 600-800 dpsi. This represents an optimum between adsorption kinetics and pressure drop.

Actual pressure drops from the present monoliths can only be measured at flow rates higher than encountered in ordinary breathing. For example up to 250 L/minute for a single 30 mm diameter monolith enables reasonably accurate measurement of ΔP. If this is scaled down, 7×20 mm diameter monoliths (as used in the canister referred to in the examples) and the flow range where the device would be used (30 L/min, 60 L/minute and 95 L/min) this comes down to a ΔP of 7, 15 or 27 Pa.

Carbonisation and Activation of Resin Structures

The formed monoliths then require to be carbonised and activated. This is preferably carried out as a two stage process as the temperatures and times are different for the two stages.

The carbonisation steps take place preferably by heating to above 600° C., preferably 700-800° C. and takes place under an inert atmosphere to prevent oxidation of the carbon. The heating rate is the critical parameter with a slower rate required for longer or larger diameter monoliths. Typical rates are between 1 C/minute and 10 C/minute. The furnace is held at the pyrolysis temperature for typically 30 minutes. For this purpose the atmosphere can be either nitrogen or carbon dioxide. In the case of carbon dioxide this is effectively inert at below 800° C. On carbonisation the material loses 40-50% weight and shrinks by about 50% volume but, provided the resin cure stage was correctly carried out, this shrinkage is accommodated with no distortion of the monolith leading to a physical structure where the ratio of the dimensions is identical to that of the resin precursor but reduced by ~30%. The macropore size is also reduced by ~30% although the macropore volume (ml/ml) remains unaltered. During carbonisation at temperatures above ~600° C. the microporosity of the carbon develops.

Carbonisation commences at ~300° C. when the decomposition of the resin and binders commences and is essentially complete by 700 C. This can be seen from the TGA data in FIG. 5. The decomposition comprises two main peaks, one at 400° C. and the second at 550 C. Typical decomposition products measured by TG/MS are shown in table 1.

TG-MS Data from Pyrolysis of Sintered Resin

| Peak temperature (° C.) | Gas | Estimated weight loss (%) |
|---|---|---|
| 120 | Water | 0.8 |
| 145 | Phenol | 0.3 |
| 210 | Water | 4.4 |
| | Phenol | 1.8 |
| | Methanol | 1.2 |
| | Carbon Dioxide | 0.4 |
| 270 | Ammonia | 2.7 |
| 370 | Unidentified | 0.3 |
| 420 | Water | 5.0 |
| | Carbon Dioxide | 0.7 |
| 580 | Water | 5.7 |
| | Carbon Dioxide | 1.3 |
| 650 | Methane | 3.8 |
| | Benzene | 3.4 |
| | Toluene | 2.7 |
| | Xylene | 1.3 |
| | Trimethylbenzene | 0.2 |
| 720 | Phenol | 4.1 |
| | Cresol | 2.6 |
| | Dimethylphenol | 1.1 |
| | Trimethylphenol | 0.1 |
| | Carbon Monoxide | 6.1 |
| 20-750 | Total | 50 |

Cherng Chang and Juanita R. Tachett, 11 Feb. 1991, *Thermochimica Acta,* 192 (1991) P 181-190

The initial decomposition, in the first peak of the TG, is predominantly due to small molecules up to and including phenol, whilst at the higher temperatures a significant proportion is due to phenols and more complex multi ring phenol and benzene derivatives. Analysis of effluent scrubber stream shows that these include up to 4 ring phenol compounds that presumably cannot diffuse to the MS in the GC-MS studies.

During carbonisation the primary nanopoarticles convert to a dense low reactivity glass carbon with a skeletal density, determined by helium pyconometry, of 1.9 g/cm$^3$. Whilst most of the decomposition products are evolved from the structure some of these convert to more reactive and lower density pyrocarbon deposits that partially fill the micropore structure. We have now found that pyrolysis in the presence of a purge is beneficial to the reactivity of the monoliths in the activation stage although it has no impact on the ultimate adsorption properties of the monolith. The carbonisation stage is preferably carried out at a slow heating rate to accommodate the shrinkage that occurs, preferably less than10° C./minute, more preferably less than 5° C./minute. The preferred heating rate is also a function of the length of the monolith to be processed. If these are less than 5 cm long the faster heating rate, around 10° C./minute may be used. If monoliths longer than 20 cm are processed slower heating rates are required to maintain acceptable straightness.

Figure 9:
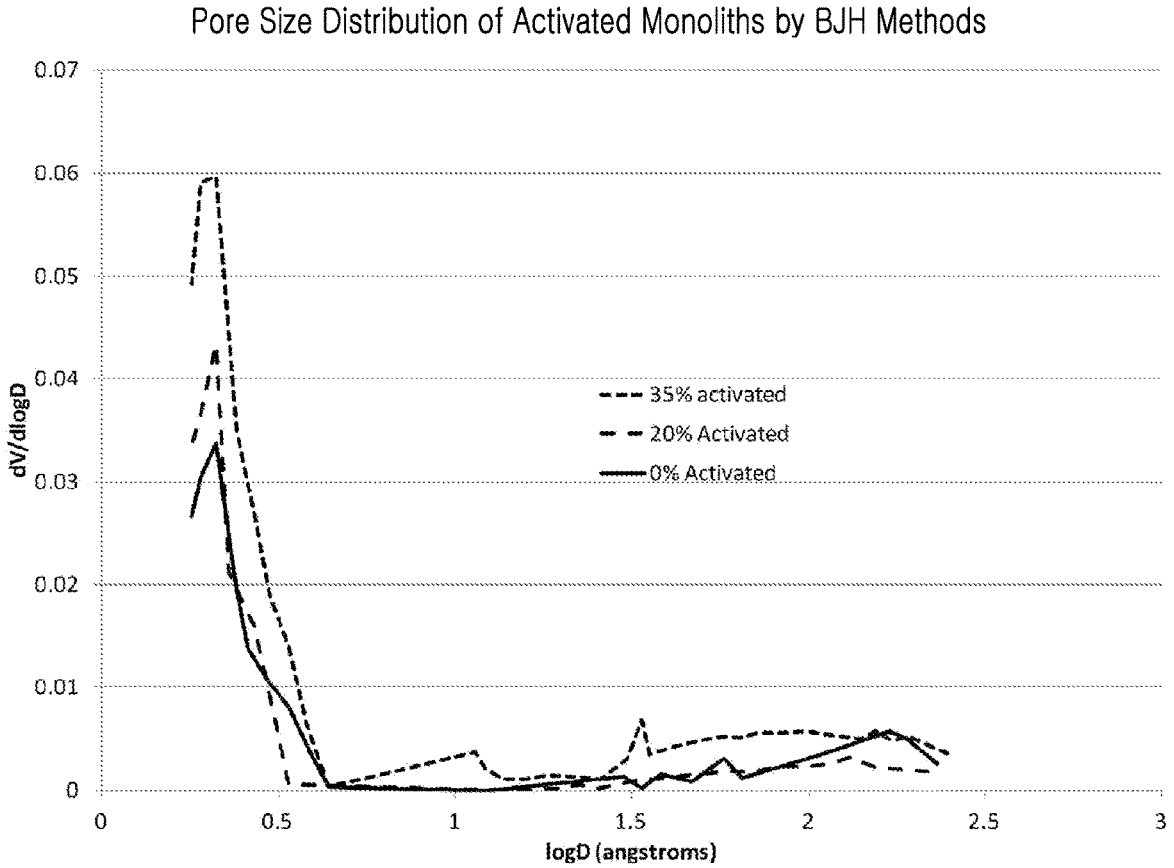
FIG. 9 is a graph showing pore size distribution of activated monoliths by BJH Method.
Figure 10:
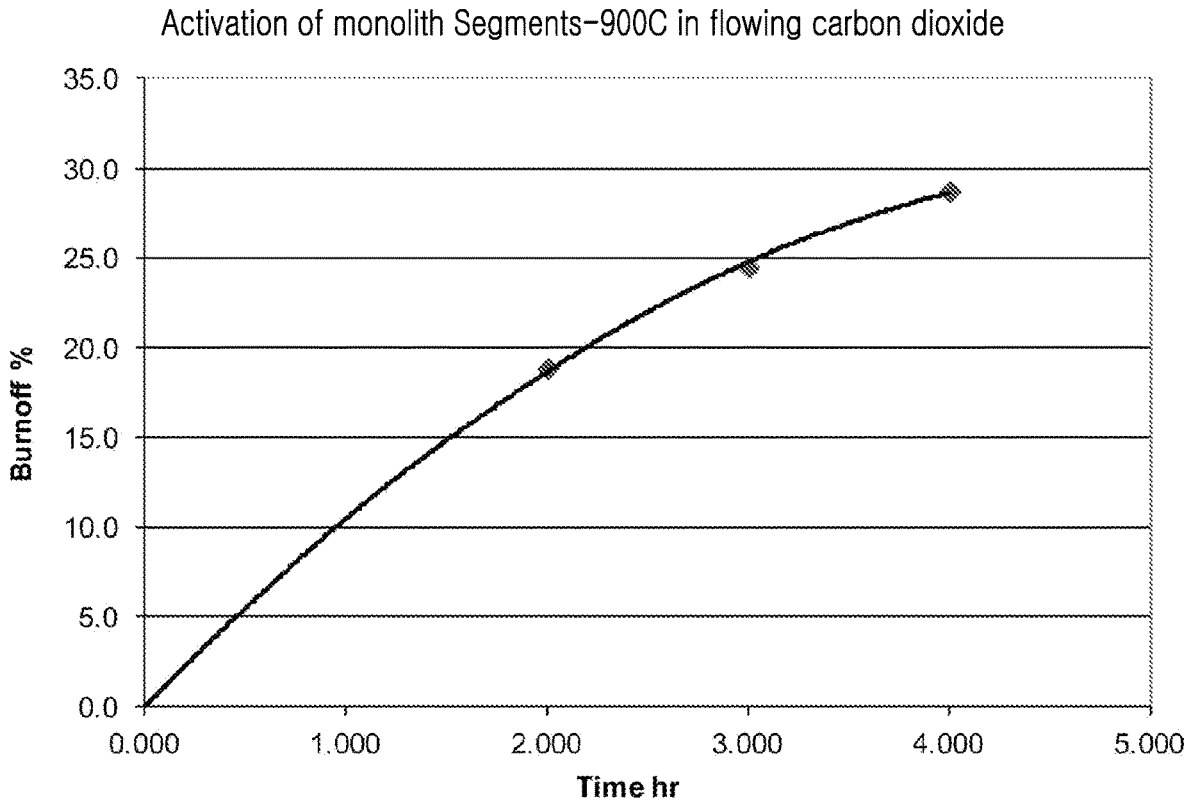
FIG. 10 is a graph showing % burnoff as a function of time for monolith segments in flowing carbon dioxide at 900° C.

Activation is carried out in carbon dioxide at temperature between 850° C. and 950° C. where the temperature and time are adjusted to provide the required weight loss. The purpose of the activation process is initially to remove the pyrocarbon deposits which have a major influence on the kinetic performance of the monolith. These deposits are more reactive than the skeletal carbon structure so the initial rate of oxidation is higher (FIG. 9). Once the pyrocarbon deposits are removed , the rate of oxidation decreases, and the subsequent activation enhances the accessible surface area, measured as m$^2$/g although, as the density of the monolith decreases, the area per piece of monolith does not change significantly. It is therefore surprising that the adsorption capacity of a fixed length of the monolith increases with activation. The impact of activation extent on the performance is shown in detail in the examples.

We have also found that whilst the carbonisation stage can be carried out using longer lengths of monoliths the activation stage is preferably carried out with the length of monolith to be used in the final canister. We believe that diffusion of the oxidising gas along the channels is limited and that, for long length of monoliths, the oxidation is due primarily to gas that diffuses radially through the monolith. This limits the extent of activation to approximately 20% weight loss as excess oxidation at the monolith outer surface leads to surface cracking. We have now shown that axial diffusion of the oxidising gas is much more efficient but is limited to approximately 5 cm from the open end of the monolith. With the expected length of the monoliths for use in the canisters being approx. 2 cm, very efficient activation can be achieved and the extent of oxidation can be increased to at least 40% without any loss in mechanical integrity.

We have surprisingly found that the use of higher activation extents (>30%) also has a positive benefit on the adsorption performance of the monoliths. In general, when a carbon is activated the surface area increases with the degree of burn off and it is generally found that the adsorption capacity per gram of carbon, which can be related to the surface area, also increases. However, the activation process also results in a decrease in bulk density. The net effect is that the surface area per unity volume at best remains constant and will in the case of conventional granular carbons actually decrease. Therefore, in any application where a fixed volume of the activated carbon is used, as against a fixed weight, which is the situation in canisters where the length of the monolith cannot be extended, little change in adsorption performance would be expected. The variation in area per unity mass and per unit volume is shown in 2 for the monolithic activated carbons of this invention. We have now found that surprisingly the adsorption capacity of the monoliths, as indicated by the BET area, on a gm/ml basis increases with burn off.

TABLE 2

Area Relationships for Phenolic Resin Derived Carbons

| Burnoff % | Monolith weight g/cm | Monolith density | BET area m2/g | BET Area m2/ml | BET Area m2/cm monolith |
|---|---|---|---|---|---|
| 0 | 1.85 | 0.54 | 649 | 350.6 | 1201 |
| 20 | 1.48 | 0.474 | 1081 | 512.4 | 1600 |
| 35 | 1.32 | 0.431 | 1323 | 570 | 1746 |

Metal Impregnation

Whilst activated carbon is well known for its high physical adsorption capacity for a wide variety of condensable vapours it has very little adsorption capacity for challenge gases such as the acid gases (e.g. sulphur dioxide), basic gases (e.g. ammonia) and the warfare agents such as HCN, $(CN)_2$ and cyanogen chloride. These can only be effectively removed using metal impregnated carbons. Known military formulations designed to remove thee agents may contain chromium, copper, silver and a variety of other metals that are referenced in a large number of earlier patents and publications.

In the earliest work by Whetzel et al (U.S. Pat. No. 1,519,470 Dec. 16, 1924) the use of carbon impregnated with copper, silver and zinc metals and oxides was demonstrated for the removal of arsine, cyanide, cyanogen chloride, and the multi-metallic formulation gave rise to the term Whetlerite. Copper and silver have been shown to be effective in the removal of arsine and phosphine. Chlorine, hydrogen chloride, hydrogen fluoride and hydrogen sulphide may also be removed by copper impregnated on carbon. In this patent it was also claimed that impregnation with these metals does not inhibit the physical adsorption of gases such as mustard and chloropicrin. Since then there have been a large number of studies aimed at improving the performance of the adsorbents. Grabenstetter et al (U.S. Pat. No. 920,050, Jan. 5, 1960) disclosed the further addition of hexavalent chromium which gave improved performance against for instance HCN, phosgene, cyanogen, cyanogen chloride and also operated more effectively under conditions of high humidity. This patent also discussed the impregnation of the metals from a mixed basic solution of all of the metallic components—copper, silver and chromium. The use of molybdenum in place of the chromium, again from a multicomponent ammonia solution, was also disclosed in the same period (U.S. Pat. No. 2,920,051, Jan. 5, 1960).

The further use of amine additives was disclosed in U.S. Pat. No. 2,963,441 (Jun. 6, 1960) to provide improved performance versus cyanogen chloride. This utilised pyridine and pyridine derivatives such as picoline. This subsequently evolved to the use of triethylene diamine (TEDA) (Maggs et al, Enhancement of CK protection by use of TEDA impregnated charcoals, technical paper No 225, CDE Porton Down, June 1977.).

A critical aspect of all of these preparation is however the requirement for the adsorbent to be able to effectively adsorb both acid and basic gases, requiring conflicting components on the carbon whilst still treating the other toxic gases and being able to adsorb the physical challenge molecules. The ability to deal adequately with both sulphur dioxide and ammonia is particularly critical and in most cases this is only achieved through the use of two separate adsorbents in either a layered or mixed bed (U.S. Pat. No. 7,004,990 Brey et al., Feb. 28, 2006). This can however lead to a significant increase in the canister size and the pressure drop through the canister.

U.S. Pat. No. 5,492,882 (Feb. 20, 1996, Calgon Carbon) disclosed the use of sulphates of copper and zinc in addition to the carbonates of copper and zinc that are normally present to provide simultaneous adsorption capability for both sulphur dioxide and ammonia. It is claimed that the method of impregnation of the mixed carbonate and sulphates is such that the physical adsorption capacity of organic vapours is not "prohibitively" reduced such that performance to CEN standards (3) for class 2 industrial filters types A, B, E and K can be achieved with 300 ml of adsorbent. The adsorbent also requires the presence of added water (up to 25% wt) to give the required performance. It is clear however that the balance of carbonate and sulphate salts for the removal of $SO_2$ and $NH_3$ respectively gives rise to a significant reduction in physical adsorption.

TABLE 3

EN 14387 Standard for Class II Respirators
CEN Requirement for Class 2 Respirators

| Gas | Type | Inlet Conc (ppm) | Outlet conc (ppm) | Service life (min) |
|---|---|---|---|---|
| $CCl_4$ | A | 5000 | 10 | 40 |
| $Cl_2$ | B | 5000 | 0.5 | 20 |
| $H_2S$ | B | 5000 | 10 | 40 |
| HCN | B | 5000 | 10 | 25 |
| $SO_2$ | E | 5000 | 5 | 20 |
| $NH_3$ | K | 5000 | 25 | 40 |

Canisters tested at 30 L/minute, 70% humidity.

In general the use of the mixed metal systems as wide spectrum adsorbents has been known for many years. The preparation of wide spectrum adsorbents based on the monolithic systems uses chemistry well known to those skilled in the art. The key differences are in the preparation from the monolithic activated carbons and the properties of the impregnated carbons. The solutions are added via a dip and drain method which is complicated by the hydrophobic nature of the carbon surface. These carbons have little or no surface oxygen and are therefore largely hydrophobic which inhibits wetting. To achieve effective impregnation it is important that after the monoliths are placed in the impregnation solution the system is evacuated and then re-pressurised to allow the solution to enter the pore structure. It is then critical that the excess solution is removed from the monolith channels. At present this is achieved by blowing but could also for instance be achieved by centrifugation.

Monolith Testing

The testing procedure used for the monoliths is a standard method used for testing canister carbons and can be adjusted to accommodate monolithic, granular or cloth based carbons. The flow diagram for the system is shown in FIG. 9. In the case of the monoliths that are the subject of this invention, single monoliths are mounted by shrink wrapping them to metal tube that is then attached to the test assembly. This is also shown in FIG. 9. Alternatively a full canister assembly can be tested.

Canister Assembly

Figure 20:
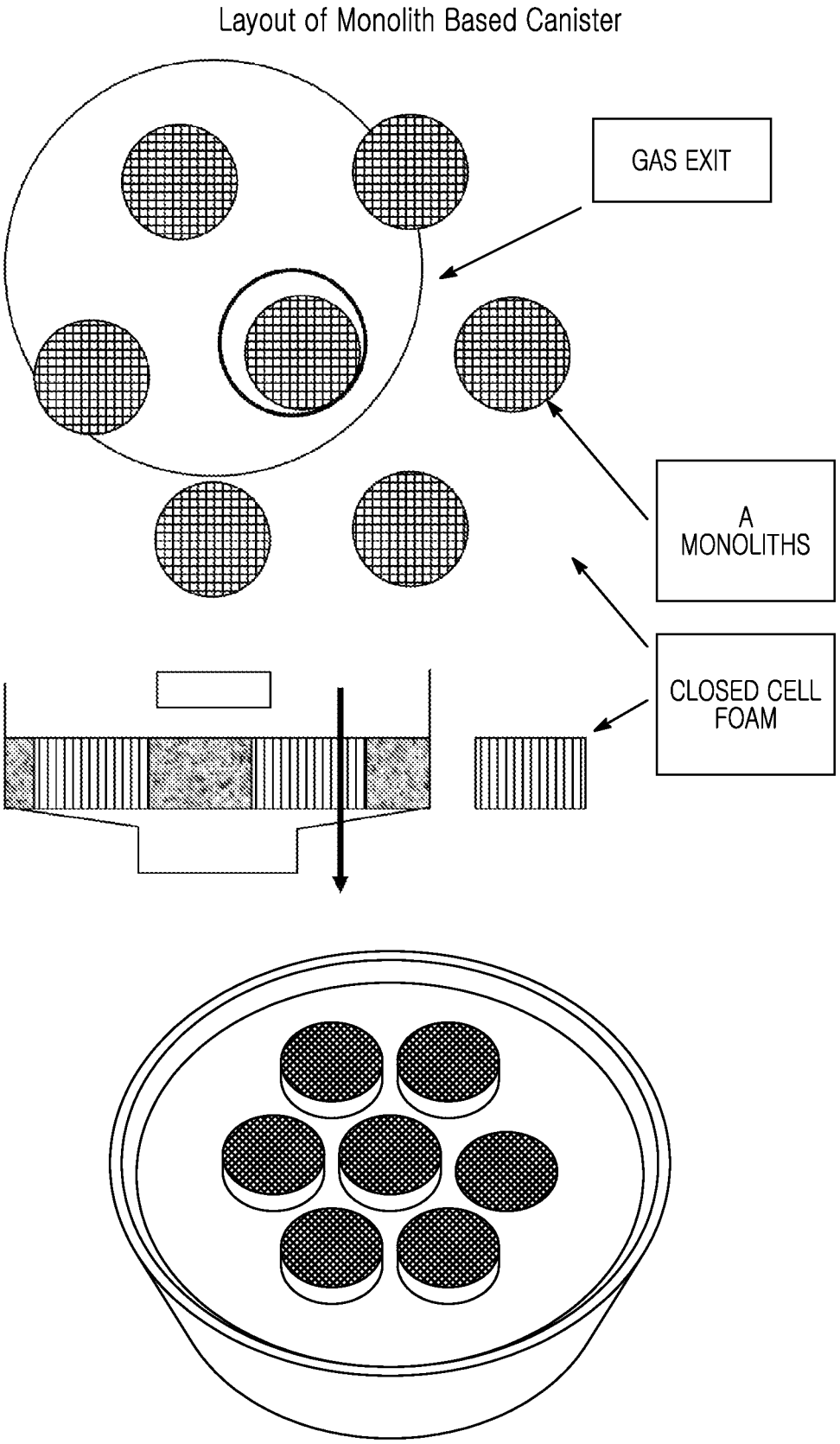
FIG. 20 is an oblique photographic view of a canister from one end.

The standard monoliths used to date are approximately 20 or 30 mm in diameter. The method of production is not easily adapted to larger round forms, typical of most military canister (10 cm diameter) or the more complex shapes frequently used in civilian protection devices, more typical of this application. To overcome this problem we have developed the novel solution shown in FIG. 20

In this instance the round monolith segments (a) are inserted into a closed cell foam (b) with holes (d) cut to be slightly smaller than the diameter of the monoliths (a). The foam/monolith assembly is then inserted into the canister housing (c). This comprises a main shell (c), a closure lid (not shown) which may contain a HEPA filter, a support plate (not shown) and optionally a gas distribution plate (also not shown).

The closed cell foam may be selected from gas impermeable chemically inert memory or resiliently flexible closed cell plastics foams, e.g. polyethylene or polypropylene homopolymer and copolymer foams. Suitable foams are available from ZOTEFOAMS PLC of Croydon, Surrey UK.

Closed cell crosslinked polyethylene foams are available under the trade name PLASTAZOTE and are formed by expansion with nitrogen which produces a pure, low odour, chemically inert foam without blowing agent residues and with a uniform cell structure and regular cell walls. Residues of blowing agents remain within chemically blown foams, can detract from their physical properties, can act as reactive impurities or contaminants and can cause an unwelcome odour. Densities from 15-30 kg/m$^3$may be used e.g. for LD24 PLASTAZOTE foam based on low density polyethylene, preferable about 24 kg/m$^3$. The grade selection was based on hardness as the monoliths have to be pushed into the laser cut holes in a sheet of the foam which has the same depth as the lengths of the monoliths, :It must therefore give enough to allow them to be pushed in to holes but must hold them firmly so that there is no bypassing or potential for the monoliths becoming loose on vibration. The higher density foams were too hard for this to be achieved easily whilst the lower density ones had too much give.

It will be appreciated that somewhat different densities may be appropriate for foams of other materials e.g. PLASTAZOTE grades based on high density polyethylene or a mixture of high and low destiny polyethylene, EVAZOTE foam based on an ethylene-vinyl acetate copolymer or PROPOZOTE base on polypropylene.

The gas distribution plate is required to achieve a more even flow of gas through all of the monolith segments as with the very low pressure drop through the monoliths the flow would preferably pass through the monoliths most directly in line with the port connecting the canister to the hood. This can be placed above or below the foam/monolith assembly and there is preferably a small gap between the plate and the monolith/foam assembly. Nonetheless the efficiency of use of the monoliths is surprising in the absence of the distributor. It would be expected that based on the open area of the gas inlet and the distribution of the monoliths that the monolith utilisation would drop to the area shown in FIG. 20.

We have however found that the efficiency of the 7 monolith array shown in the figure is ~80% of that expected from 7 individual monoliths rather than the ~15% expected from the directly accessed area.

This method of assembly is extremely flexible and permits the use of more complex shaped canisters which may be curved to more closely follow the shape of the head. Alternatively the approach could be used to build the adsorbents in for instance the chin strap of a helmet assembly or the helmet itself. The construction can also be applied to large flat filters for use in building air conditioning systems or in radial flow filters. It also removes problems generally associated with achieving fully dense packing with granular adsorbents, particularly in non-circular formats.

The invention will now be illustrated in the following examples.

EXAMPLE 1

Figure 6A:
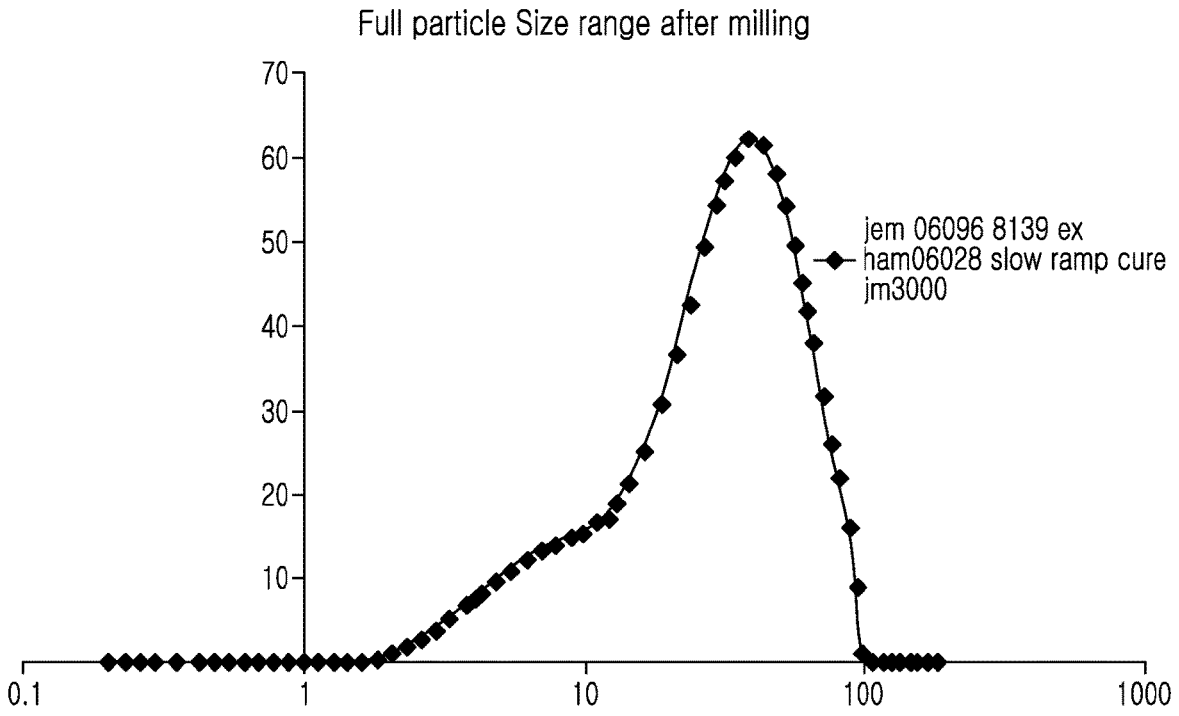
FIG. 6A is a graph showing particle size distribution of jet milled resin and FIG. 6B is a graph showing particle size distribution of the resin after classification to remove fines.
Figure 6B:
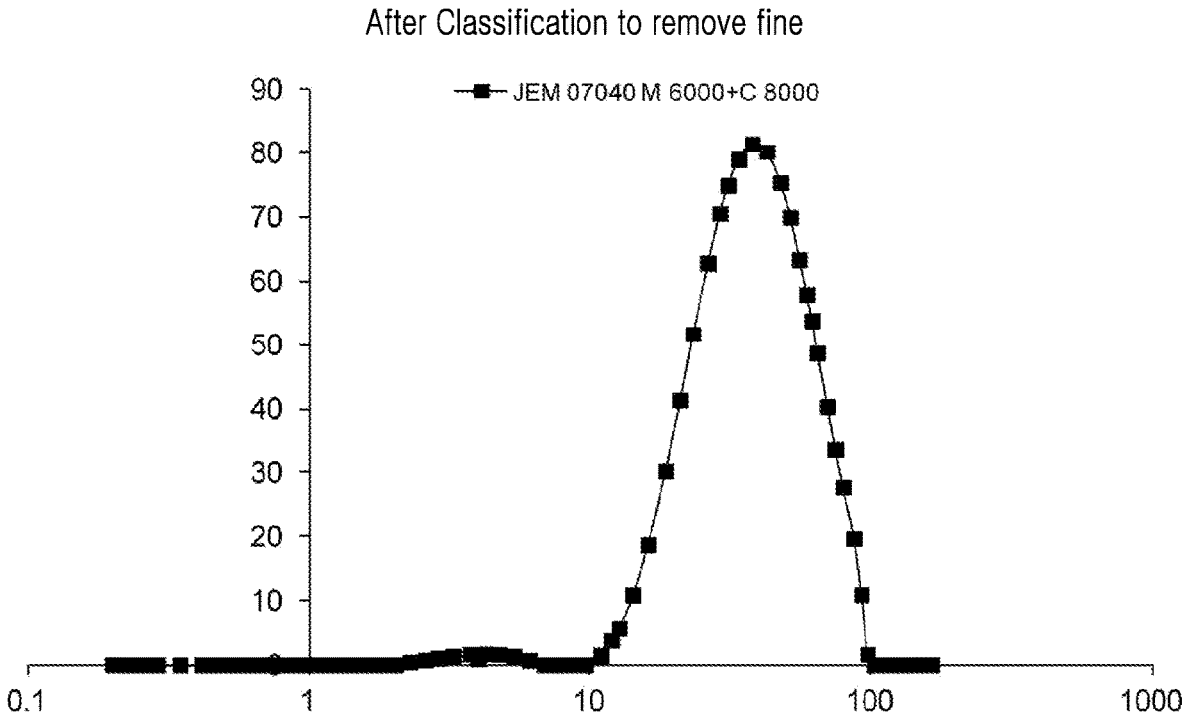
Figure 7:
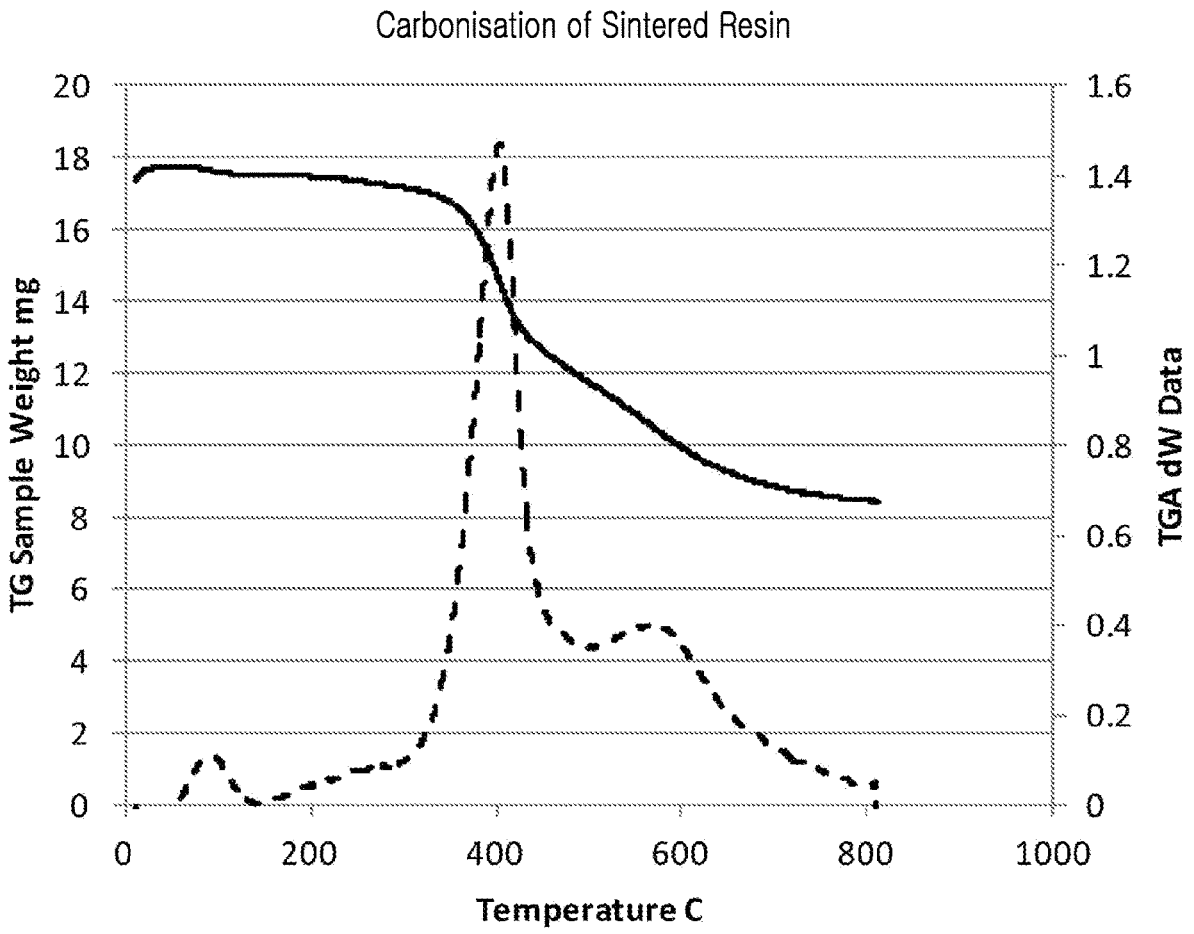
FIG. 7 is a thermogravimetric plot of sample weight and rate of weight loss as a function of temperature for carbonisation of sintered resin.

Preparation of Monolithic Porous Phenolic Resins and Corresponding Activated Monolithic Carbons The phenolic resin precursor, a Novolak resin code J1011 supplied by MOMENTIVE , was co-milled with 5% weight hexamethylene tetramine to a mean particle size of 40 μm with $D_{97}$ passing 70 μm. The co-milled resin was then placed in trays with a depth of 5 cm and subjected to a cure ramp of 100° C/hour to a 100° C., hold for 1 hour, ramp to 150° C. at 100° C/hour, hold for 1 hour and then cool. The resulting biscuits of cured resin were then hammer milled to provide particles with a majority of particle size of <1 mm. The particles were then jet milled in a 300 AFG mill to give a product resin having a bimodal particle size distribution with a primary peak at 40 μm (FIG. 6A). The resulting powdered resin was then classified using a 100 AFG Jet Mill at 8000 rpm to remove the smaller peak (FIG. 6B). The average fines content was between 10 and 20%. 8 wt % of the fines was then added back to the 40micron powder.

This powder was then formed into a dough in a Z-blade mixer using water, methocell and polyethylene oxide along with low concentrations of other polymer additives used to control the visco-elastic properties. The dough was then extruded using a die to produce a square channel monolith using a small piston extruder (200 ml capacity). It was mounted in an Instron load frame that allowed flexible control of the extrusion speed and provided a readout of the force applied during extrusion. The extruded monolith was placed on a roller table to dry under ambient conditions. After 2 days the monolith was sufficiently dry to be carbonised and activated Larger amounts of monolith were produced using the same procedure but were extruded with a Sulby ram extruder capable of taking approximately 10 L of dough.

After drying the monoliths were cut into lengths of up to about 4 cm length for pyrolysis. Pyrolysis was carried out in a either a box furnace or a tube furnace. In the box furnace the monoliths were packed in a container (30 cm×30 cm) in a bed of granular carbon to prevent any air accessing the monoliths and the container was purged with approximately 5 L/minute of carbon dioxide. The furnace was heated to 700 C at 1 C/minute, held for 30 minutes and was then allowed to cool naturally. Alternatively the monoliths were placed in a stainless crucible in a 5 cm diameter purged tube with a purge flow of 5 L/minute inside a large furnace. In this furnace the heating cycle was dictated by the size of the furnace but took approximately 10 hours to reach 700° C. after which the heating was terminated and the furnace was allowed to cool naturally. In this instance the position of the monoliths relative to the purge inlet were also noted. In both cases the weights and dimensional changes during pyrolysis were noted.

After carbonisation, the monoliths were cut into the 10, 15, 20, 25 and 30 mm lengths required for the canister testing programmes. These were loaded into a crucible which was mounted in a tubular furnace. The positions of the different length monoliths in the crucible were randomised and their positions in the tube relative to the gas inlet were noted to allow a detailed analysis of the impact of the monolith length on the activation extent. The monoliths were processed in carbon dioxide flow of 3 L/minute. The furnace was heated to the reaction temperature of 900° C. and held there for between 1 and 4 hours to achieve the different levels of burn off required for the test programme. The weights and dimensions of the segments before and after activation were noted The characteristics of the monoliths carbonised in the purged box furnace are shown in Table 1A. It can be seen that the repeatability between the monolith segments was excellent with an average weight loss of 52.9±0.2% weight.

TABLE 1A

Pyrolysis of Resin Monoliths in Purged Box Reactor

| | | Green | | | | Carbonised | | | | |
|---|---|---|---|---|---|---|---|---|---|---|
| Prod ID | /Id | Wt g | L mm | Ø mm | Wt/mm | Wt g | L mm | Ø mm | Wt/mm | % wt loss |
| AF01-B | 1 | 42.16 | 140 | 27 | 0.301 | 19.71 | 107 | 20.7 | 0.184 | 53.25 |
| AF01-B | 2 | 41.60 | 140 | 27 | 0.297 | 19.54 | 106 | 20.7 | 0.184 | 53.03 |
| AF01-B | 3 | 41.23 | 140 | 27 | 0.295 | 19.38 | 105 | 20.7 | 0.185 | 53.00 |
| AF01-A | 4 | 41.82 | 140 | 27 | 0.299 | 19.71 | 105 | 20.7 | 0.188 | 52.87 |
| AF01-A | 5 | 41.94 | 140 | 27 | 0.300 | 19.74 | 108 | 20.7 | 0.183 | 52.93 |
| AF01-A | 6 | 42.07 | 140 | 27 | 0.301 | 19.79 | 109 | 20.7 | 0.182 | 52.96 |
| AF01-C | 7 | 41.46 | 140 | 27 | 0.296 | 19.48 | 108 | 20.7 | 0.180 | 53.01 |
| AF01-C | 8 | 41.77 | 140 | 27 | 0.298 | 19.64 | 108 | 20.7 | 0.182 | 52.98 |
| AF01-C | 9 | 41.51 | 140 | 27 | 0.297 | 19.45 | 108 | 20.7 | 0.180 | 53.14 |
| AG01-B | 10 | 42.40 | 140 | 27 | 0.303 | 19.89 | 108 | 20.7 | 0.184 | 53.09 |
| AG01-B | 11 | 42.06 | 140 | 27 | 0.300 | 19.74 | 108 | 20.7 | 0.183 | 53.07 |
| AG01-B | 12 | 42.00 | 140 | 27 | 0.300 | 19.75 | 108 | 20.7 | 0.183 | 52.98 |
| AG02-D | 13 | 42.97 | 140 | 27 | 0.307 | 20.26 | 108 | 20.7 | 0.188 | 52.85 |
| AG02-D | 14 | 42.82 | 140 | 27 | 0.306 | 20.29 | 108 | 20.7 | 0.188 | 52.62 |
| AG02-D | 15 | 42.91 | 140 | 27 | 0.307 | 20.37 | 108 | 20.7 | 0.189 | 52.53 |
| AF03-C | 16 | 42.52 | 140 | 27 | 0.304 | 20.10 | 108 | 20.7 | 0.186 | 52.73 |
| AF03-C | 17 | 43.13 | 140 | 27 | 0.308 | 20.37 | 108 | 20.7 | 0.189 | 52.77 |
| AF03-C | 18 | 42.75 | 140 | 27 | 0.305 | 20.20 | 108 | 20.7 | 0.187 | 52.75 |
| AG02-C | 19 | 42.79 | 140 | 27 | 0.306 | 20.28 | 108 | 20.7 | 0.188 | 52.61 |
| AG02-C | 20 | 42.45 | 140 | 27 | 0.303 | 20.11 | 108 | 20.7 | 0.186 | 52.63 |
| AG02-C | 21 | 42.80 | 140 | 27 | 0.306 | 20.11 | 108 | 20.7 | 0.186 | 53.01 |
| | | | | mean | 0.302 | 19.900 | 107.619 | 20.700 | 0.185 | 52.895 |
| | | | | st. dev | 0.004 | 0.323 | 1.024 | 0.000 | 0.003 | 0.196 |
| | | | | % dev | 1.330 | 1.625 | 0.951 | 0.000 | 1.471 | 0.370 |

Figure 12:
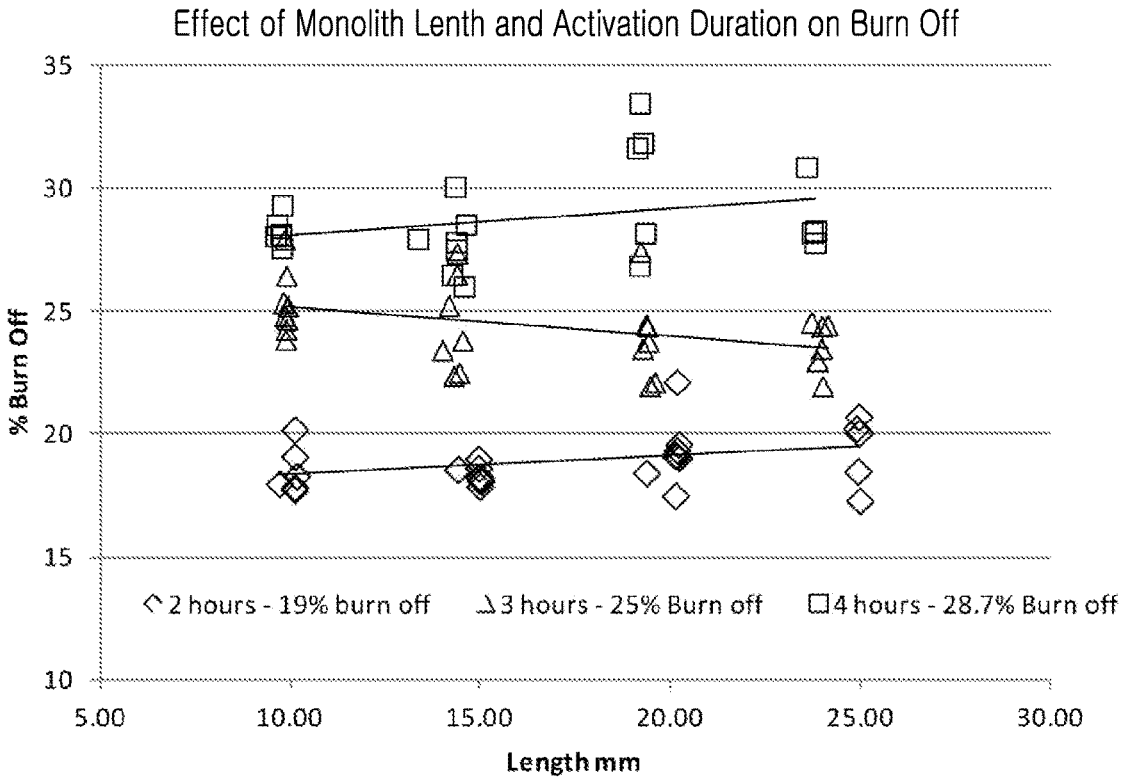
FIG. 12 is a graph in which % burn off is plotted against monolith length and activation duration.

The 14 cm carbonised segments were then cut into 10, 15, 20 and 25 mm lengths for activation. The activation was carried out in the tubular furnace for between 1 and 4 hours to achieve the target weights losses. The oxidised monolith properties are shown in Table 1B (4 hours), Table 1C (3 hours) and Table 1D and the impact of monolith length on burn off is shown in FIG. 12. The variability in burn off at constant length reflects the position of the monoliths in the tube furnace with a higher activation rate observed at the feed gas inlet to the tube. Without wishing to be bound by this we believe that this is due to inhibition of the reaction by carbon monoxide, which has been reported in the literature. It is clear however that, allowing for the variation due to position, that the length of the monolith in lengths up to 25 mm has had little impact on the extent of activation.

TABLE 1B

Monolith Segments Oxidised for 4 Hours at 900 C.

| Pro ID | Sample | l srinkage % | volume V1-V2 | v srinkage % | Wt/mm | | Burnoff % |
|---|---|---|---|---|---|---|---|
| AG02-D/14 | 18 | 5.35 | 1.09 | 16.01 | 0.132 | | 31.7 |
| AG02-C/21 | 12 | 4.65 | 0.52 | 15.39 | 0.135 | | 28.6 |
| AF03-C/17 | 44 | 4.88 | 1.31 | 15.59 | 0.140 | | 27.8 |
| AG02-C/21 | 11 | 4.13 | 0.51 | 14.92 | 0.136 | | 28.1 |
| AF01-C/9 | 36 | 3.58 | 0.73 | 14.43 | 0.135 | | 26.0 |
| AG02-D/14 | 17 | 4.68 | 1.04 | 15.41 | 0.140 | | 26.9 |
| AF01-C/9 | 34 | 4.62 | 0.77 | 15.36 | 0.136 | | 26.5 |
| AF01-B/1 | 8 | 4.13 | 0.51 | 14.93 | 0.133 | | 28.2 |
| AF01-C/7 | 39 | 4.14 | 0.75 | 14.93 | 0.132 | | 27.9 |
| AF01-A/6 | 41 | 4.42 | 1.27 | 15.18 | 0.134 | | 28.3 |
| AG02-D/15 | 25 | 4.63 | 1.04 | 15.36 | 0.127 | | 33.5 |
| AF03-C/17 | 45 | 5.76 | 1.38 | 16.37 | 0.134 | | 30.9 |
| AF01-C/9 | 37 | 4.47 | 0.77 | 15.22 | 0.131 | | 30.1 |
| AF01-B/1 | 3 | 4.13 | 0.51 | 14.92 | 0.134 | | 27.6 |
| AF01-B/1 | 2 | 4.95 | 0.53 | 15.65 | 0.133 | | 28.1 |
| AF01-C/7 | 40 | 3.75 | 0.75 | 14.59 | 0.131 | | 28.6 |
| AG02-D/15 | 23 | 3.93 | 1.00 | 14.75 | 0.138 | | 28.2 |
| AF01-C/9 | 32 | 4.58 | 0.78 | 15.33 | 0.134 | | 27.5 |
| AG02-C/21 | 10 | 3.27 | 0.48 | 14.16 | 0.133 | | 29.3 |
| AF01-C/7 | 38 | 4.33 | 0.76 | 15.10 | 0.134 | | 28.0 |
| AF03-C/18 | 48 | 4.70 | 1.29 | 15.43 | 0.139 | | 28.3 |
| AG02-D/14 | 16 | 4.18 | 1.01 | 14.97 | 0.130 | | 31.9 |
| | | | | | 0.134 | average | 28.7 |
| | | | | | 0.003 | | 1.838 |

TABLE 1C

| Monolith Segments Oxidised for 3 hours at 900 C. | | | | | | | |
|---|---|---|---|---|---|---|---|
| | | Activation | | | | | |
| Pro ID | Sub-Sample | l srinkage % | volume V1-V2 | v srinkage % | Wt/mm | | Burnoff % |
| AF01-B/3 | 55 | 3.60 | 1.07 | 12.69 | 0.138 | | 24.5 |
| AG01-B/11 | 63 | 3.99 | 0.45 | 13.04 | 0.142 | | 24.3 |
| AF01-A/5 | 84 | 2.93 | 0.82 | 12.08 | 0.144 | | 22.2 |
| AG02-C/20 | 69 | 3.85 | 0.63 | 12.91 | 0.144 | | 23.5 |
| AF03-C/16 | 52 | 3.93 | 1.09 | 12.99 | 0.149 | | 22.0 |
| AG02-C/20 | 71 | 4.48 | 0.68 | 13.48 | 0.148 | | 22.4 |
| AG02-C/20 | 74 | 3.80 | 0.65 | 12.87 | 0.148 | | 22.5 |
| AF01-A/5 | 87 | 3.62 | 0.86 | 12.71 | 0.144 | | 22.0 |
| AG01-B/12 | 80 | 4.28 | 0.90 | 13.30 | 0.143 | | 23.5 |
| AF03-C/16 | 50 | 4.64 | 1.15 | 13.63 | 0.148 | | 23.0 |
| AF01-C/8 | 79 | 3.20 | 0.62 | 12.33 | 0.140 | | 23.9 |
| AF01-B/3 | 53 | 4.05 | 1.10 | 13.09 | 0.142 | | 23.5 |
| AF01-A/5 | 86 | 4.31 | 0.91 | 13.33 | 0.140 | | 24.5 |
| AF01-C/8 | 75 | 4.71 | 0.69 | 13.69 | 0.136 | | 27.4 |
| AG01-B/12 | 83 | 4.86 | 0.94 | 13.83 | 0.138 | | 27.5 |
| AG02-C/20 | 73 | 4.20 | 0.67 | 13.23 | 0.141 | | 26.5 |
| AG01-B/11 | 67 | 4.48 | 0.47 | 13.49 | 0.141 | | 25.4 |
| AF03-C/16 | 51 | 3.82 | 1.08 | 12.88 | 0.144 | | 24.5 |
| AG01-B/11 | 65 | 4.09 | 0.45 | 13.13 | 0.142 | | 23.9 |
| AG01-B/11 | 66 | 4.10 | 0.45 | 13.14 | 0.141 | | 24.9 |
| AG01-B/12 | 82 | 3.67 | 0.86 | 12.76 | 0.142 | | 23.8 |
| AG01-B/11 | 64 | 3.70 | 0.44 | 12.78 | 0.141 | | 24.7 |
| AG01-B/10 | 59 | 3.79 | 0.45 | 12.86 | 0.140 | | 25.3 |
| AG01-B/12 | 81 | 4.11 | 0.89 | 13.15 | 0.140 | | 24.4 |
| AF01-C/8 | 78 | 5.60 | 0.73 | 14.50 | 0.140 | | 25.3 |
| AG01-B/10 | 60 | 3.98 | 0.45 | 13.04 | 0.138 | | 26.5 |
| AF01-B/3 | 54 | 4.90 | 1.16 | 13.87 | 0.141 | | 24.6 |
| AG01-B/10 | 56 | 4.66 | 0.47 | 13.65 | 0.136 | | 28.0 |
| | | | | 13.16 | 0.142 | average | 24.5 |
| | | | | | 0.003 | | 1.630 |

TABLE 1D

| Monolith Segments Oxidised for 2 hours at 900 C. | | | | | | | |
|---|---|---|---|---|---|---|---|
| Pro ID | Sample | l srinkage % | volume V1-V2 | v srinkage % | Wt/mm | | Burnoff % |
| AF03-C/17 | 46 | 3.89 | 0.94 | 11.18 | 0.152 | | 21 |
| AF01-A/4 | 26 | 2.15 | 0.46 | 9.57 | 0.149 | | 19 |
| AG02-C/21 | 13 | 3.20 | 0.69 | 10.54 | 0.153 | | 18 |
| AF01-B/1 | 4 | 2.97 | 0.35 | 10.33 | 0.150 | | 18 |
| AF01-B/1 | 1 | 1.75 | 0.30 | 9.20 | 0.148 | | 18 |
| AF03-C/18 | 49 | 3.45 | 0.90 | 10.77 | 0.156 | | 17 |
| AG02-D/13 | 20 | 3.53 | 0.73 | 10.84 | 0.155 | | 18 |
| AF01-B/1 | 7 | 2.48 | 0.34 | 9.87 | 0.150 | | 18 |
| AF01-A/4 | 29 | 2.87 | 0.52 | 10.23 | 0.151 | | 18 |
| AF01-C/9 | 33 | 3.40 | 0.54 | 10.72 | 0.150 | | 18 |
| AG02-D/15 | 22 | 3.77 | 0.75 | 11.07 | 0.155 | | 19 |
| AG02-D/13 | 21 | 3.28 | 0.72 | 10.61 | 0.152 | | 19 |
| AF01-A/6 | 42 | 3.46 | 0.90 | 10.78 | 0.148 | | 20 |
| AG02-D/14 | 15 | 3.97 | 0.76 | 11.25 | 0.149 | | 22 |
| AF01-B/1 | 6 | 3.66 | 0.37 | 10.97 | 0.146 | | 20 |
| AF01-A/4 | 27 | 3.35 | 0.54 | 10.67 | 0.150 | | 19 |
| AF01-B/1 | 5 | 2.76 | 0.35 | 10.13 | 0.149 | | 18 |
| AF01-A/6 | 43 | 3.13 | 0.88 | 10.48 | 0.151 | | 19 |
| AF01-A/4 | 29 | 3.54 | 0.55 | 10.85 | 0.152 | | 18 |
| AF01-C/9 | 35 | 3.47 | 0.54 | 10.78 | 0.149 | | 18 |
| AG02-C/21 | 14 | 3.47 | 0.73 | 10.78 | 0.152 | | 19 |
| AG02-C/21 | 9 | 2.48 | 0.34 | 9.87 | 0.150 | | 19 |
| AF01-A/4 | 30 | 2.74 | 0.51 | 10.11 | 0.151 | | 18 |
| AF01-A/4 | 31 | 2.48 | 0.50 | 9.87 | 0.150 | | 19 |
| AG02-D/15 | 24 | 3.42 | 0.73 | 10.74 | 0.153 | | 20 |
| AG02-D/13 | 19 | 3.57 | 0.74 | 10.88 | 0.154 | | 19 |
| AF03-C/18 | 47 | 3.33 | 0.89 | 10.66 | 0.152 | | 20 |
| | | | | 10.5 | 0.151 | average | 18.9 |
| | | | | 0.503 | 0.003 | st. ev | 1.095 |

The second set of samples were prepared in the purged tubular furnaces using monoliths with a green length of 75 mm. A typical set of data is show in Table 4. Comparison with Table 1 shows that the change in the purge conditions has had essentially no impact on the pyrolysis weight loss (52.9±0.2% wt vs. 52.4±0.4% wt) or the dimensions.

TABLE 2

Pyrolysis of Resin Monoliths in Purged Tube Reactor

| | Green | | | | Carbonised | | | | |
|---|---|---|---|---|---|---|---|---|---|
| Prod ID | Wt g | L mm | Ø mm | Wt/mm | Wt g | L mm | Ø mm | Wt/mm | wt loss |
| AG05/1 | 23.0 | 75 | 27 | 0.307 | 10.9 | 59.3 | 21.0 | 0.184 | 52.61 |
| AG05/2 | 22.5 | 72 | 27 | 0.313 | 10.7 | 58.1 | 21.1 | 0.184 | 52.44 |
| AG05/3 | 22.8 | 73 | 27 | 0.312 | 10.8 | 59 | 21.1 | 0.183 | 52.63 |
| AG05/4 | 23.2 | 75 | 27 | 0.309 | 11 | 60 | 21.1 | 0.183 | 52.59 |
| AG05/5 | 22.9 | 74 | 27 | 0.309 | 10.9 | 59.5 | 21.1 | 0.183 | 52.40 |
| AG05/6 | 22.6 | 72 | 27 | 0.314 | 10.8 | 59.1 | 20.9 | 0.183 | 52.21 |
| AG05/7 | 24.1 | 76 | 27 | 0.317 | 11.5 | 61.2 | 21.2 | 0.188 | 52.28 |
| AG05/8 | 23.0 | 75 | 27 | 0.307 | 11.3 | 60.3 | 21.2 | 0.187 | 50.87 |
| AG05/9 | 23.4 | 77 | 27 | 0.304 | 11.1 | 60.6 | 21.0 | 0.183 | 52.56 |
| AG05/10 | 23.0 | 74 | 27 | 0.311 | 10.9 | 59.4 | 21.2 | 0.184 | 52.61 |
| AG05/11 | 23.2 | 76 | 27 | 0.305 | 11 | 59.5 | 21.1 | 0.185 | 52.59 |
| AG05/12 | 23.9 | 77 | 27 | 0.310 | 11.4 | 61.5 | 21.0 | 0.185 | 52.30 |
| AF04/1 | 23.3 | 77 | 27 | 0.303 | 11 | 60.3 | 21.2 | 0.182 | 52.79 |
| AF04/2 | 23.9 | 77 | 27 | 0.310 | 11.3 | 61.4 | 21.0 | 0.184 | 52.72 |
| AF04/3 | 22.8 | 75 | 27 | 0.304 | 10.8 | 59 | 21.2 | 0.183 | 52.63 |
| AF04/4 | 23.6 | 77 | 27 | 0.306 | 11.3 | 61 | 21.0 | 0.185 | 52.12 |
| AF04/5 | 22.8 | 77 | 27 | 0.296 | 10.9 | 59 | 21.4 | 0.185 | 52.19 |
| AF04/6 | 22.7 | 73 | 27 | 0.311 | 10.8 | 58.5 | 21.0 | 0.185 | 52.42 |
| AF04/7 | 23.5 | 75 | 27 | 0.313 | 11.2 | 60.7 | 21.2 | 0.185 | 52.34 |
| AF04/8 | 22.9 | 73 | 27 | 0.314 | 10.9 | 59.8 | 21.3 | 0.182 | 52.40 |
| AF04/9 | 23.6 | 77 | 27 | 0.306 | 11.2 | 60.1 | 21.3 | 0.186 | 52.54 |
| AF04/10 | 23.0 | 74 | 27 | 0.311 | 11 | 59.4 | 21.0 | 0.185 | 52.17 |
| AF04/11 | 23.5 | 76 | 27 | 0.309 | 11.1 | 60 | 21.2 | 0.185 | 52.77 |
| AF04/12 | 22.3 | 72 | 27 | 0.310 | 10.6 | 57 | 21.0 | 0.186 | 52.47 |
| | | | mean | 0.31 | 11.02 | 59.74 | 21.12 | 0.184 | 52.40 |
| | | | st. dev | 0.00 | 0.23 | 1.07 | 0.12 | 0.00 | 0.38 |

These monoliths were cut into 15, 20 and 25 mm segments for activation. This was carried out in the same tube furnace as the earlier samples. Activation was only carried out at 900° C. for 4 hours as the adsorption tests demonstrated that the higher level of activation was preferred. Typical activation results are shown in Table 5. Comparison with Table 3B, where the activation was also carried out for 4 hours, shows that a higher level of activation was achieved (35.5±0.38% loss) with the samples pyrolysed in the purged tube furnaces as compared to those prepared in the box furnace (28.7±1.8% loss) despite the identical pyrolysis weight losses.

TABLE 3

Activation of Monoliths Prepared in Purged Tube Pyrolysis Furnace

| | | Activation | | | | |
|---|---|---|---|---|---|---|
| Pro ID | Sub-Sample | l srinkage % | volume V1-V2 | v srinkage % | Wt/mm | Burnoff % |
| AG05-1 | A | 7.08 | 1.36 | 18.12 | 0.130 | 35.5 |
| AG05-2 | B | 7.55 | 1.39 | 18.54 | 0.135 | 33.4 |
| AG05-2 | C | 7.04 | 1.36 | 18.09 | 0.135 | 32.7 |
| AG05-3 | D | 7.18 | 1.34 | 18.21 | 0.137 | 32.3 |
| AG05-3 | E | 6.67 | 1.32 | 17.76 | 0.135 | 33.1 |
| AG05-4 | F | 6.71 | 1.03 | 17.80 | 0.130 | 35.0 |
| AG05-4 | G | 7.41 | 1.05 | 18.41 | 0.127 | 36.3 |
| AG05-5 | H | 6.67 | 1.03 | 17.76 | 0.130 | 35.7 |
| AG05-7 | I | 6.80 | 1.58 | 17.88 | 0.131 | 35.1 |
| AG05-8 | J | 7.39 | 1.67 | 18.40 | 0.121 | 39.4 |
| AG05-9 | K | 7.26 | 1.60 | 18.28 | 0.127 | 36.4 |
| AG05-9 | L | 7.45 | 1.66 | 18.45 | 0.133 | 33.7 |
| AG04-1 | M | 6.67 | 1.32 | 17.76 | 0.134 | 33.4 |
| AG04-2 | N | 7.04 | 1.27 | 18.09 | 0.132 | 34.4 |
| AG04-2 | O | 7.14 | 1.35 | 18.18 | 0.132 | 34.1 |
| AG04-3 | P | 7.77 | 1.36 | 18.73 | 0.132 | 34.8 |

TABLE 3-continued

| Activation of Monoliths Prepared in Purged Tube Pyrolysis Furnace | | | | | | | |
|---|---|---|---|---|---|---|---|
| | | Activation | | | | | |
| Pro ID | Sub-Sample | l srinkage % | volume V1-V2 | v srinkage % | Wt/mm | | Burnoff % |
| AG04-3 | Q | 7.69 | 1.37 | 18.67 | 0.129 | | 36.6 |
| AG03-2 | R | 7.73 | 1.37 | 18.70 | 0.129 | | 37.6 |
| AG03-4 | S | 7.69 | 1.37 | 18.67 | 0.125 | | 38.6 |
| AG03-4 | T | 7.01 | 1.36 | 18.06 | 0.118 | | 42.3 |
| | | | | 18.23 | 0.130 | average | 35.5 |
| | | | | | 0.005 | | 2.490 |
| | | | | | | | 8.88 |

Figure 8:
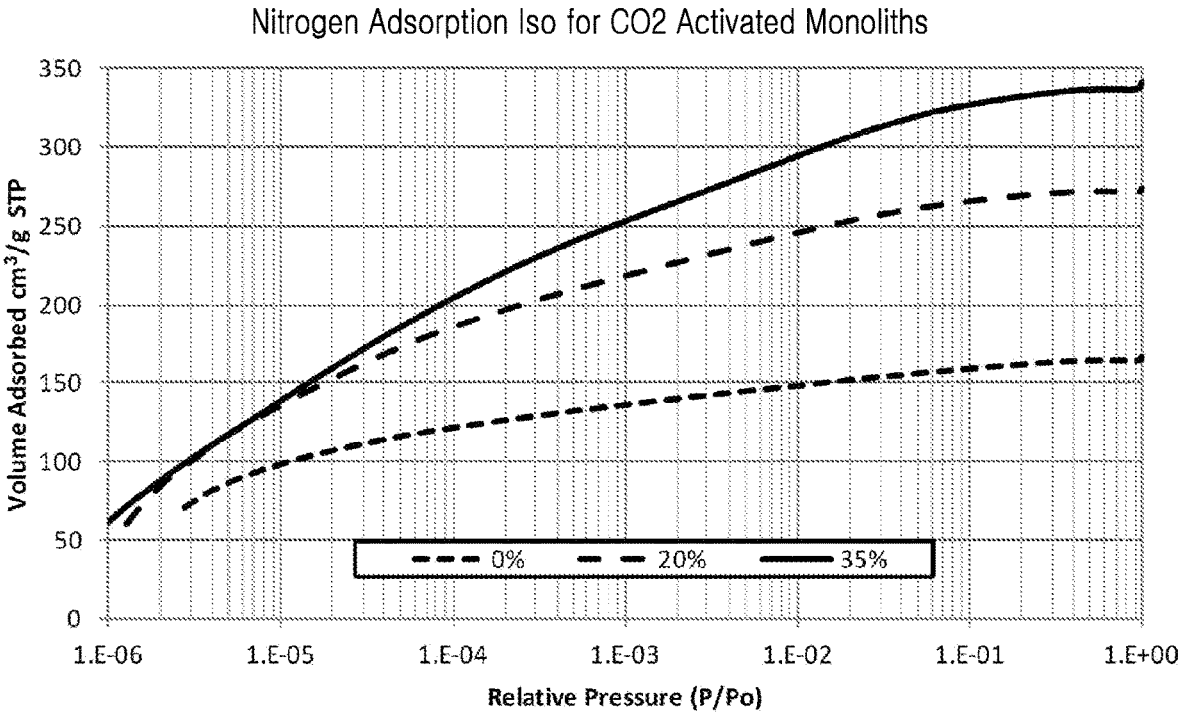
FIG. 8 shows nitrogen adsorption isotherms for monoliths activated with carbon dioxide.

Nitrogen adsorption analysis of the oxidized monoliths gave the isotherms shown in FIG. 8 whilst the pore size distributions, determined by the BJH method are shown in FIG. 9. These figures demonstrate the introduction of some pores in the larger mesopore range at 35% activation along with a progressive increase in the micropore volume. The properties of the monoliths are summarised in Table 6 where the surface area is given as $m^2/g$, $m^2/ml$ and m2/cm of monolith. The BET area is determined by the BET method using the C-factor correction method of Rouquerol. Surface areas are usually quoted as $m^2/g$ however $m^2/ml$ is a more representative value for a canister carbon where granular materials are loaded on a fixed volume basis. In this case however a constant number of monoliths are loaded into the canister or effectively a constant length of monoliths.

TABLE 4

| Monolith Properties | | | | | |
|---|---|---|---|---|---|
| Burnoff % | Monolith weight g/cm | Monolith density | BET area $m^2/g$ | BET Area $m^2/ml$ | BET Area $m^2/cm$ monolith |
| 0 | 1.85 | 0.54 | 649 | 350.6 | 1201 |
| 20 | 1.48 | 0.474 | 1081 | 512.4 | 1600 |
| 35 | 1.32 | 0.431 | 1323 | 570 | 1746 |

EXAMPLE 2

Cyclohexane Adsorption Performance of Activated Carbon Monoliths

The cyclohexane adsorption performance of the activated carbon monoliths described in example 1 was assessed using the breakthrough equipment shown in FIG. 8. The monolith segments were dried in a vacuum overnight at 120° C. before being shrink wrapped onto 22 mm copper tubes which were then mounted in the adsorption vessel shown in FIG. 9.

Figure 13A:
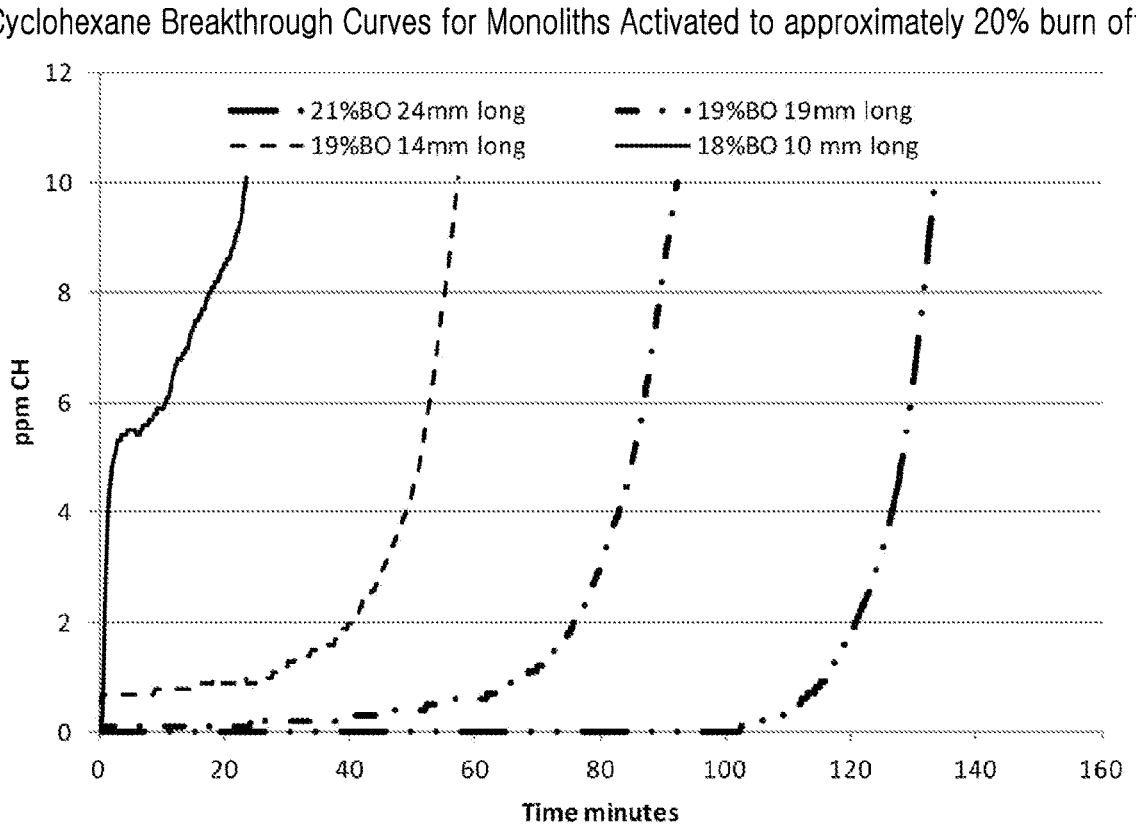
FIG. 13A is a graph showing ppm cyclohexane plotted against time in minutes and shows cyclohexane breakthrough curves for monoliths activated to approximately 20% burn off.
Figure 13B:
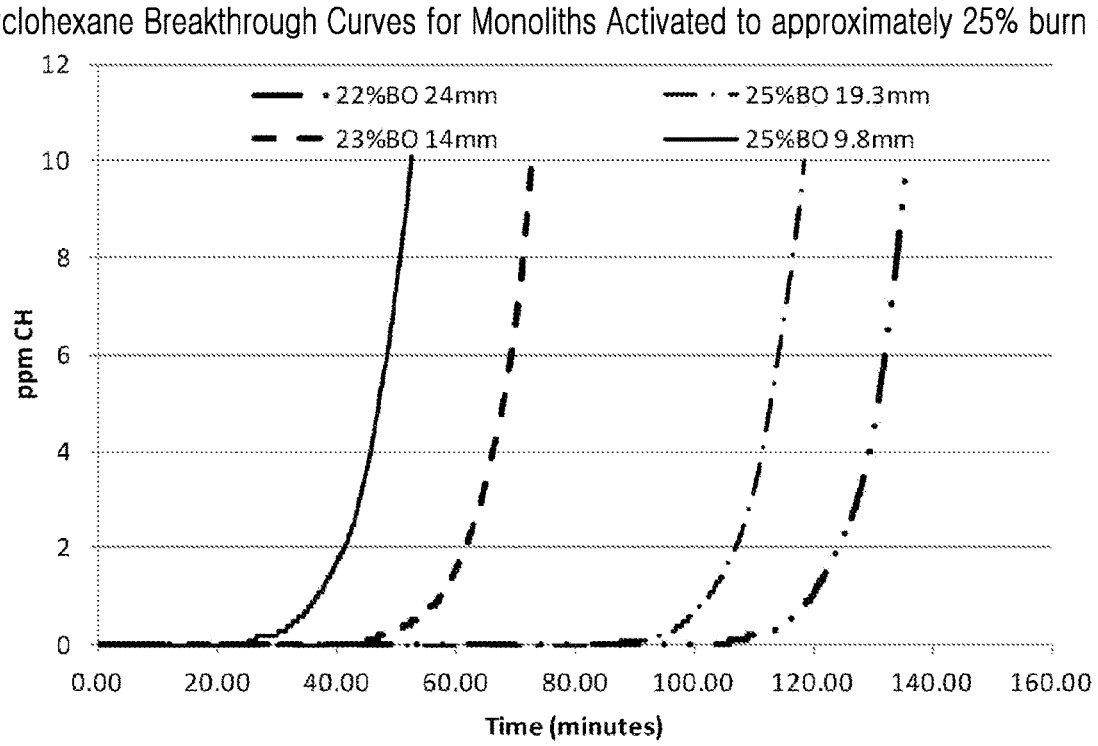
FIG. 13B is a similar graph for monoliths activated to approximately 25% burn off.
Figure 13C:
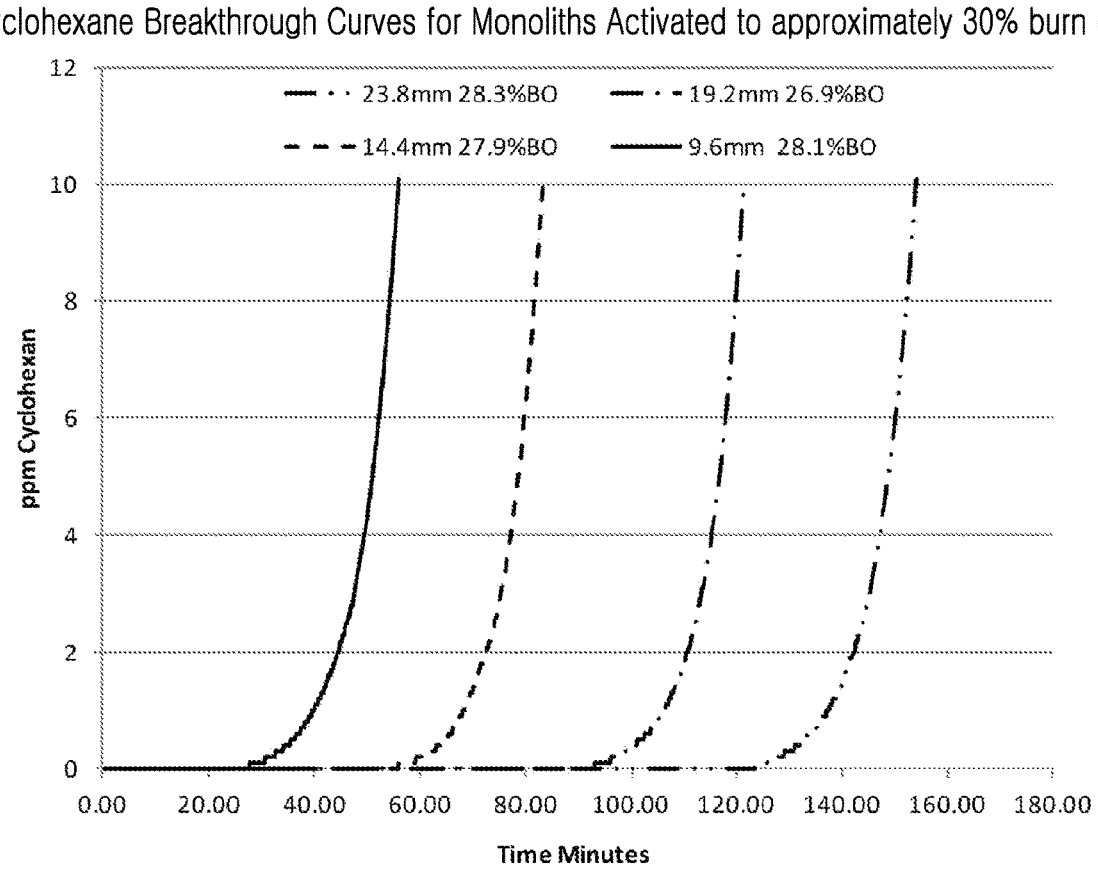
FIG. 13C is a further similar graph for monoliths activated to approximately 30% burn off.

The test comprised flowing a 1.2 L/minute of dry air containing 1000 ppm volume of cyclohexane through the monolith and detecting the cyclohexane content of the effluent gas stream. The tests examined the impact of monolith length and degree of activation on performance. FIG. 13A shows the breakthrough curves for the 10 to 25 mm monoliths activated to between 18 and 21% burn off. FIG. 13B shows the breakthrough curves for monoliths activated to between 22 and 25% BO and FIG. 11C for monoliths activated to between 26.9 and 28.3%BO.

The shape of the curves in FIG. 13A at ~20% Burn-Off is indicative of quite severe diffusional inhibition with almost instant breakthrough for the 10 mm monolith and instant low level breakthrough leading to a more normal breakthrough at approx 40 minutes for the 14 mm monolith. This can be compared to the results in FIG. 11B for monoliths activated to only slightly higher extent, between 22 and 25% burn off, where even for the 10 mm monolith the breakthrough is normal.

Figure 14:
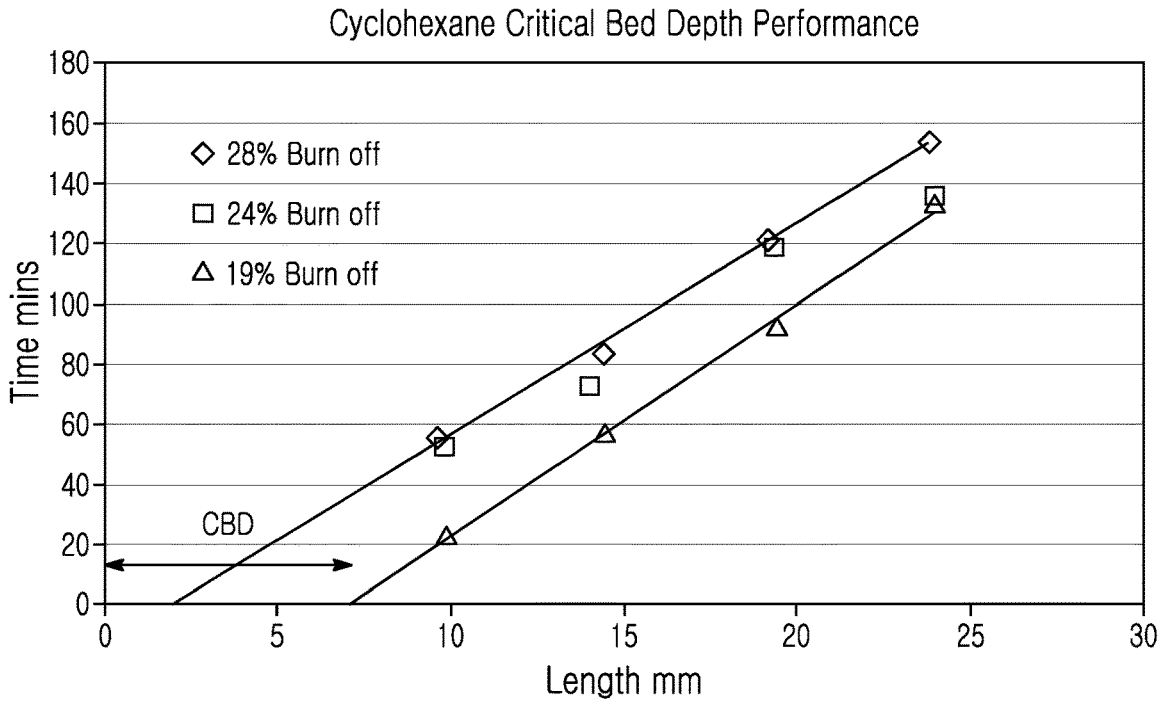
FIG. 14 is a plot of time a plot showing cyclohexane critical bed depth performance for monoliths at 19%, 24% and 28% burn off.

The monoliths can also be compared using a critical bed depth plot where the time to reach 10 ppm in the effluent is plotted versus monolith length. This is shown in FIG. 14. The very small critical bed depth for both the ~24% and the ~28% monoliths is surprising given the open channel structure and immeasurably small pressure drop. The significantly higher CBD for the 19% activated monoliths reflects the poor diffusion properties and indicates that for bed depths (monolith lengths) less than 7 mm there would be instantaneous breakthrough. Nonetheless the very marked difference between the 19% and the 24% activated monoliths is dramatic.

Figure 15:
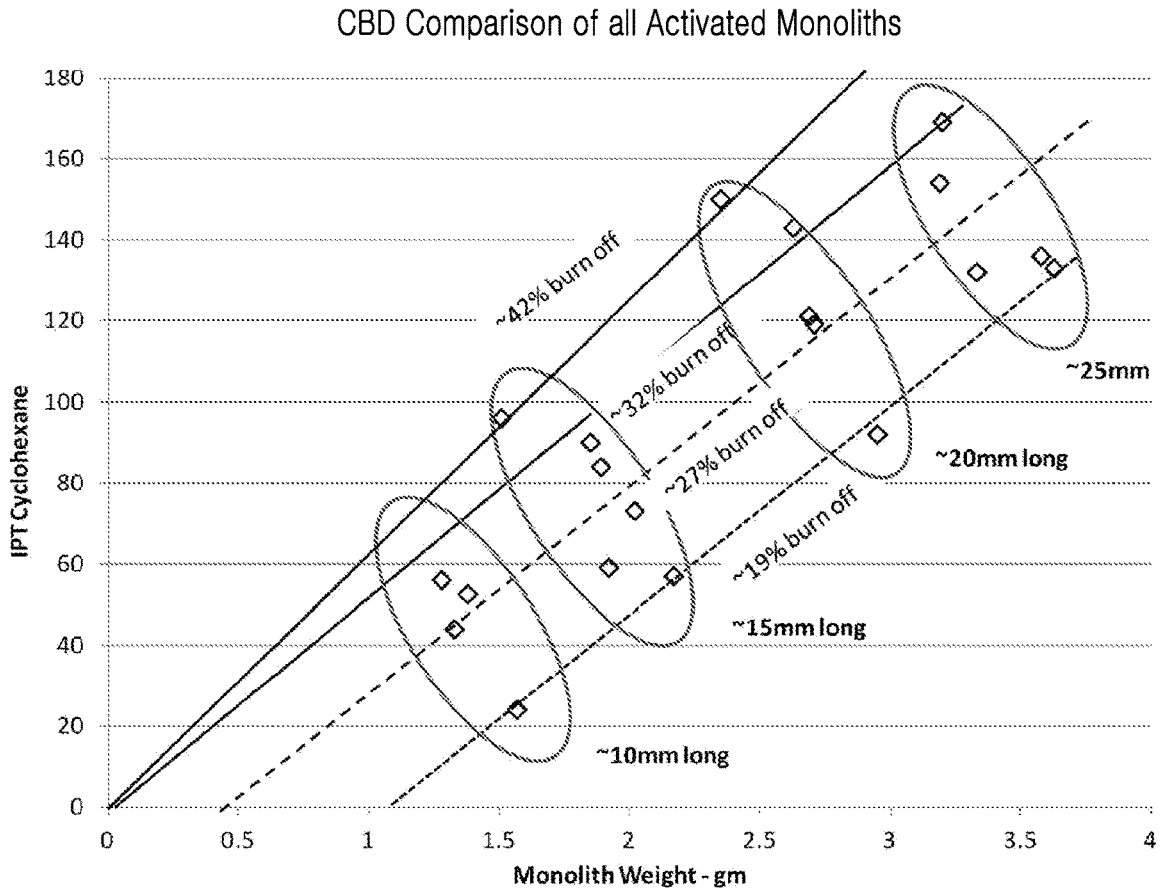
FIG. 15 is a CBD comparison of all activated monoliths and is a plot of IPT cyclohexane against monolith weight.

FIG. 15 shows the breakthrough time for cyclohexane for all of the monoliths tested as a function of monolith weight and allows an overview of the impact of all of the properties. The monoliths fall into 4 clusters where the lengths are ~10, 15, 20 and 25 mm and can also be divided approximately into regions according to the weight loss during activation. This demonstrates the unexpected enhanced performance at the higher burn-off levels. It also indicates that the observed benefits from the monoliths pyrolysed in the tubular furnace derive predominantly from an increased reactivity leading to a higher degree of activation and not to any more fundamental structural property.

EXAMPLE 3

Metal Impregnated Monoliths

For effective protection against agents other than those that can be adequately physical adsorbed impregnation with a mixture of metal compounds and TEDA is required. Methods of impregnation are well known to those skilled in the art and at present the formulation used has not been optimised. Based on the performance of the monoliths for cyclohexane adsorption, and the observed benefit from using higher activation extents, these results are limited to the higher burn off monoliths in the range from 30 to 36% weight loss. This production method is described below:

Impregnation is carried out by placing monoliths into a vacuum vessel to which an ammoniacal solution containing 6% zinc, 6% copper, 2.5% molybdate and 0.05% silver sufficient to completely submerge all the pieces is added. The vessel is then evacuated and repressurised several times until no bubbles are seen to evolve from the monolith channels. The monoliths are then removed from the vessel and all excess solution is blown out of the channels and then dried at 100 C for 2 hours The monoliths were then finally calcined at 180° C. overnight.

Figure 16:
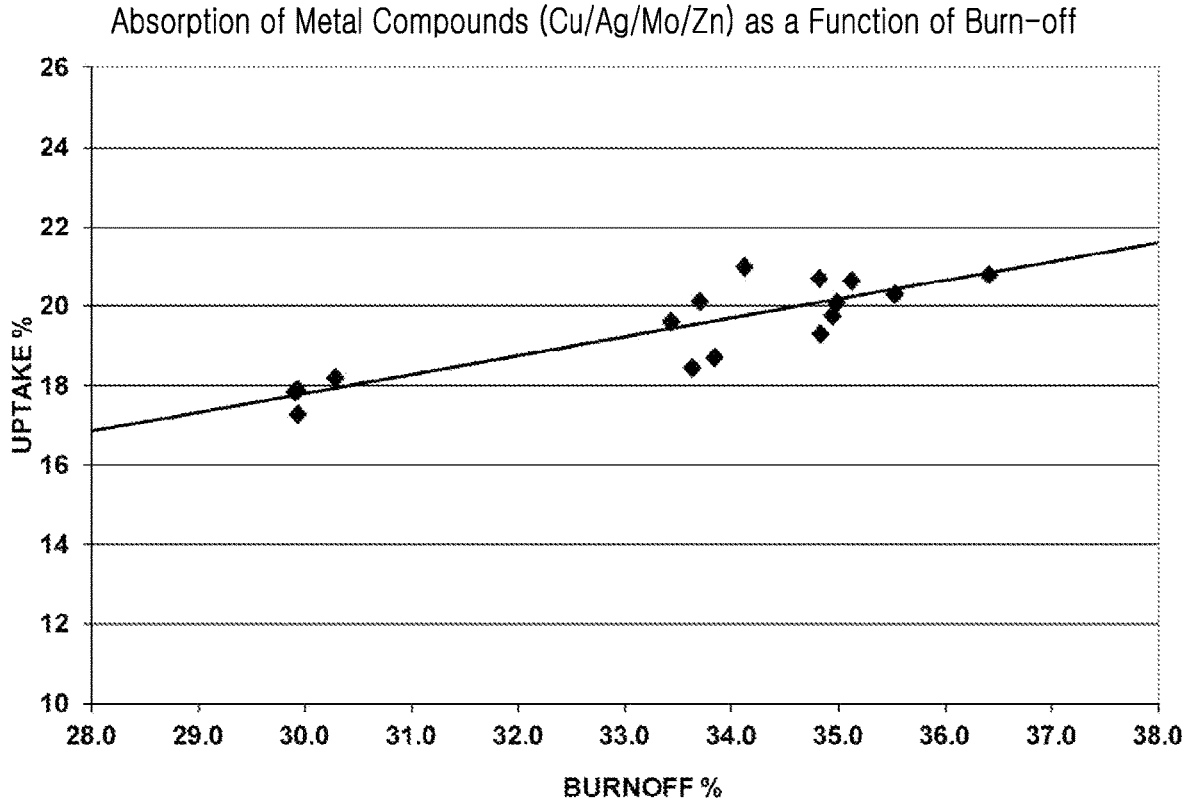
FIG. 16 is a graph showing adsorption of metal compounds (Cu/Ag/Mo/Zn) as a function of burn off.

The weight uptake of the components described above, after baking at 180° C. in air is shown in FIG. 16. The variability of the weight uptake (19.4±1.2%) is actually less than the variability in the extent of activation (33.4±2.2%) despite working with monoliths with lengths varying between 15 and 24 mm demonstrating the reproducibility of the method.

In some cases post impregnation with TEDA may be required. This is carried out by placing the monolith into a gas-tight container together with the required weight of TEDA held in a small test tube. The gas tight container is then sealed and heated to 60° C. for 30mins and then left to cool down slowly. After 12 hours no TEDA is left in the test tube.

EXAMPLE 4

Adsorption on Impregnated Monoliths

The challenge gases that have been investigated, in addition to cyclohexane, are ammonia, sulphur dioxide and hydrogen cyanide. A critical aspect of this is that in conventional canister carbons the addition of the metal compounds and TEDA can seriously inhibit the adsorption of the physically adsorbed vapours. It is also claimed in some cases that a significant level of adsorbed water is required to allow the metallic compounds to function which can then lead to a deterioration of the carbon.

All the tests were carried out at 1.2 L/minute with 1000 ppm of the challenge gas in the feed stream. The breakthrough conditions are summarised below:

| Component | Detection limit ($mg/m^3$) | Breakthrough criterion $mg/m^3$ | Breakthrough criterion ppm |
|---|---|---|---|
| Hydrogen cyanide | 0.4 | 11.2 | 10 |
| Ammonia | 0.7 | 17.7 | 25 |
| Sulphur dioxide | 0.5 | 13.3 | 5 |
| Cyclohexane | 0.2 | 35 | 10 |

Figure 18:
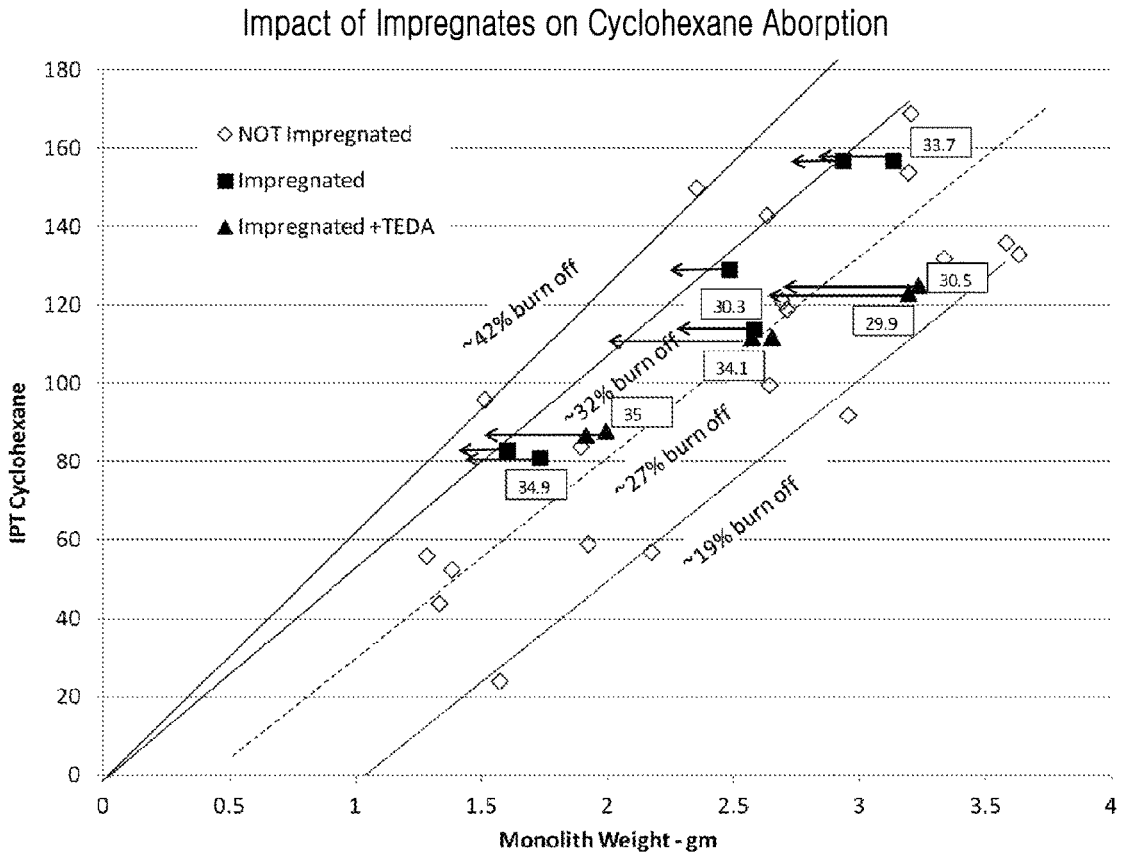
FIG. 18 is a plot of IPT cyclohexane against monolith weight in gm for monoliths which have not been impregnated, which have been impregnated and which have been impregnated+TEDA and showing the effect of impregnates on cyclohexane adsorption.

The impact of impregnating the monolithic carbons on the cyclohexane adsorption is shown in FIG. 18 where the breakthrough data for the metal impregnated (filled squares) and metal plus TEDA impregnated monoliths (filled triangles) are shown superimposed on the un-impregnated data (open squares) from example 2 (FIG. 15). The numbers in the open boxes are the activation extent for the monoliths and the black arrows indicate where the performance would have been in the absence of the impregnants. The data indicates that the 20% weight metal impregnation results in approximately a 10% loss in cyclohexane performance whilst the further addition of 4% weight of TEDA reduces the overall cyclohexane performance by approximately 20%. This represents a small net reduction compared to conventional carbons for such high loadings and could be compensated for by increasing the extent of activation.

Figure 17:
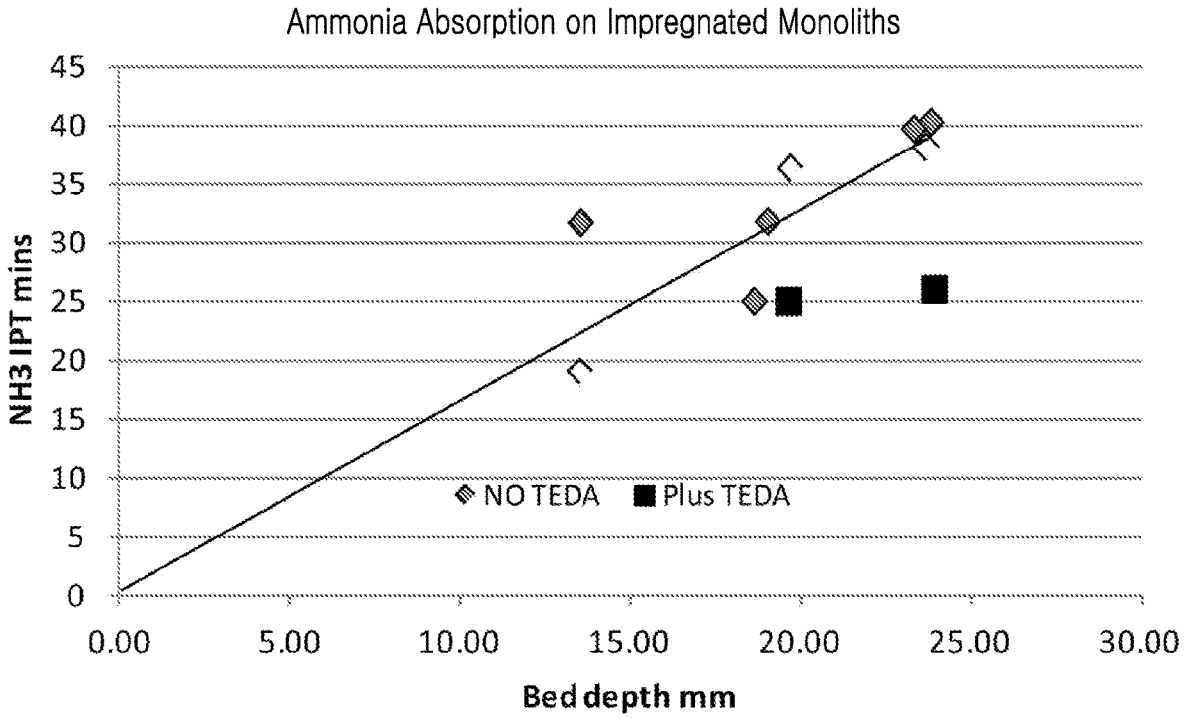
FIG. 17 is a plot of $NH_3$ IPT in minutes against bed depth in mm showing ammonia adsorption on impregnated monoliths.

The adsorption of ammonia on the impregnated activated carbons was carried out at 50% relative humidity (RH) on dry monoliths and in some cases using pre-humidified monoliths. One was tested at 80% RH but this had no impact on the ammonia breakthrough. Test conditions were 1.2 L minute with the breakthrough at 25 ppm ammonia. Some of the monoliths were pre-humidified by placing the monoliths in a constant RH (43%) dessicator. The water pickup at this condition was surprisingly low at approximately 3% wt. The performance of the monoliths as a function of the weight loading of impregnants is shown in FIG. 17. The open diamonds are for the pre-humidified monoliths whilst the closed diamonds are the dry monoliths. It can be seen that pre-humidification at this level has had little effect on the ammonia adsorption. The squares are for the monoliths with further added TEDA and there is evidence that this has reduced the ammonia adsorption. However other tests, carried out at higher humidity actually showed a benefit.

Additional tests including HCN and $SO_2$ are shown below. These were carried out at 1.2 L/minute, 70% RH. These demonstrate good performance for HCN but some inhibition of the $SO_2$ by the TEDA.

TABLE 5

Other Challenge Gases

| Monolith | | HCN | $SO_2$ | NH3 |
|---|---|---|---|---|
| 211JUL12 | Cu/Mo/Ag | 59 | 43 | 55 |
| 211JUL13 | Cu/Mo/Ag-TEDA | 74.2 | 21 | 102 |

EXAMPLE 5

Adsorption on Full Canister

Figure 19:
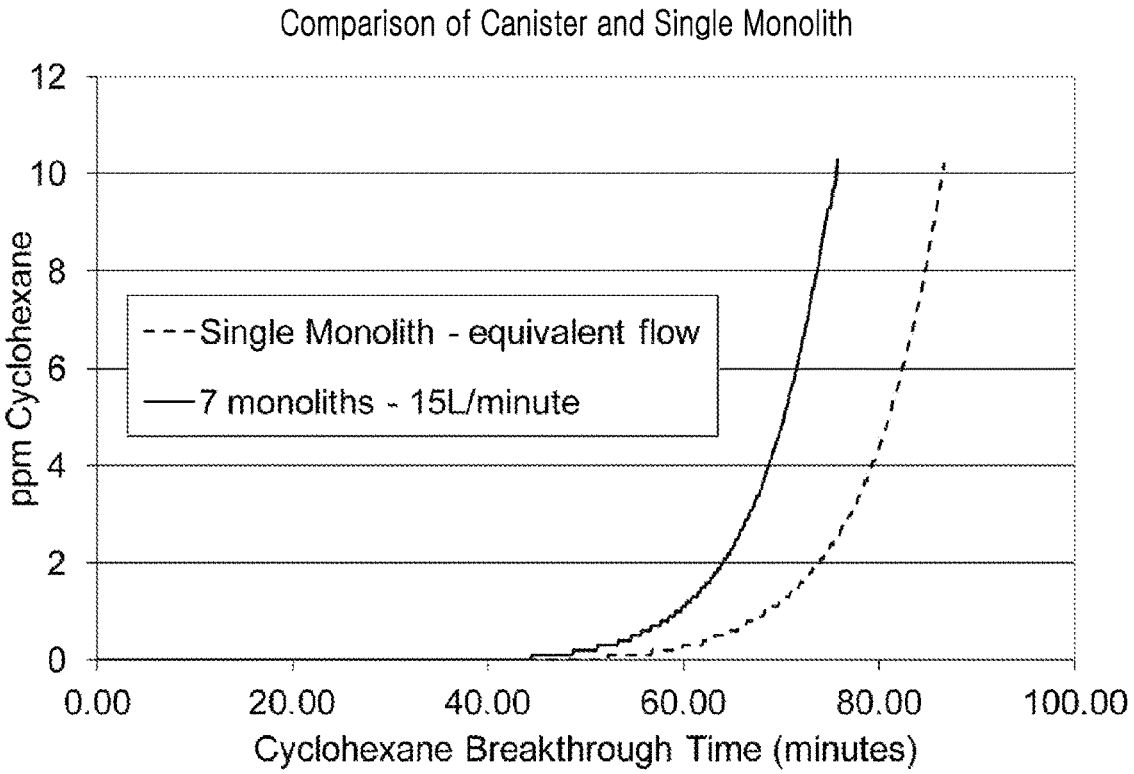
FIG. 19 is a plot of ppm cyclohexane against time in minutes showing cyclohexane breakthrough for a canister and for a single monolith.

All of the tests discussed in the preceding examples were based on a single, nominal 20 mm diameter, monolith and these were tested at 1.2 L/minute as this represented the scale factor for a conventional military gas mask with a single 10 cm diameter canister with a total flow of 30 L/minute. However the hood design of this invention is based on twin canisters where the number of monoliths to be used can be adjusted to match the performance requirement. If the simplest layout of 7 monoliths in a hexagonal array is considered, the total monolith cross section for a two canister design would be 42 $cm^2$. For a total flow rate of 30 L/minute this equates to 2.1 L/minute through a single monolith. It was therefore necessary to test both the canister at 30 L/minute flow and a single monolith at 2.1 L/minute to provide the required comparison. The results for cyclohexane are shown in FIG. 19. The loss in performance for the canister relative to the single monolith was approximately 13%. However if the structure of the canister is considered only the central monolith is directly in line with the gas exit (FIG. 18). As such the 87% efficiency is remarkably good for a system with an immeasurably small pressure drop where the gas flow could have been expected to be in direct line of sight to the gas outlet. The distribution over all the monoliths can be further improved through the use of a perforated distribution plate and the inclusion of the HEPA filter.

The invention claimed is:

1. A low pressure drop personal protection device for providing protection against a range of toxic industrial chemicals and chemical warfare agents and capable of being worn by a wide range of users, said device comprising:

a flexible polymeric hood in the form of a bag for fitting over the head and neck in which a polymer of which said hood is formed is selected to be impermeable to toxic challenge molecules, the entry to the bag being big enough to cope with all sizes of head and hair styles whilst still closing effectively around all neck sizes;

a neck seal for sealing the hood about the neck of a user and including an adjustable elasticated strap, wherein the hood at least adjacent the neck is of film of thickness ≤0.1 mm so that when folded around the neck and held in place by the strap, the folds are compact to provide the seal;

a half mask for providing connection to a canister; and a low pressure drop canister for providing chemical protection, wherein the canister comprises:

a housing;

a multiplicity of stable monolithic activated carbon structures contained in the housing in a side-by-side relationship and each of said monolithic activated carbon structures being of porous carbon in a single cylindrical piece and not granular and not composed of granular carbons bound together by a binder, of 15-40 mm diameter and length 1-3 cm with a cellular structure providing longitudinally directed transport channels each extending through each monolith from one end to the other, the transport channels being square and of size between 400 and 800 μm, wall thickness between 400 and 800 μm, open area 30-40% and cell density 600-800 cells per square inch, and wherein the monoliths are activated to >24 wt % weight loss; and a single sheet of resilient closed cell plastics foam for mounting the monoliths into the housing in which the sheet is contained, the sheet being planar or curved to follow a shape of the housing and of thickness which is the same as the length of the monoliths also contained in and fitted to the housing, the foam sheet having multiple individual openings spaced apart from one another, cut through the foam from one face to the other and each cut to be smaller than the diameter of the monoliths;

the monoliths each being inserted individually into one of the openings with the channels of each monolith extending from one face of the sheet to its opposing face and the foam sheet forcing a flow of gases through the individual monoliths in parallel for removal of any of the toxic challenge molecules therein, a grade of the plastics foam being selected to give enough to allow the monoliths to be pushed into their respective openings but to hold the monoliths firmly so that there is no bypassing or potential for the monoliths becoming loose on vibration.

2. The device of claim 1, wherein the film of the hood is made of a flexible polyester.

3. The device of claim 1, wherein the hood incorporates a window of a transparent polymer.

4. The device of claim 1, wherein the half mask has retaining straps for assistance in collapsing the hood around the head to minimize dead volume.

5. The device of claim 1, wherein the monoliths are the result of partially curing a phenolic resin to a solid, comminuting the partially cured resin, extruding the comminuted resin, sintering the extruded resin so as to produce a form-stable sintered product and carbonising and activating the form-stable sintered product.

6. The device of claim 1, wherein each monolith is between 15 and 30 mm diameter.

7. The device of claim 1, wherein the monolith has a surface area of at least 700 $m^2$l/g.

8. The device of claim 1, wherein the monolith is activated to >30 wt % weight loss.

9. The device of claim 1, wherein the monoliths are impregnated with materials selected from at least one metallic additive and triethylene diamine.

10. The device of claim 9, wherein the monoliths are impregnated with one or more of said metallic additives which are selected from the group consisting of copper, molybdenum, silver and zinc.

11. The device of claim 1, wherein the canister further comprises a distributor plate for producing an even distribution of the stream of the gases to all of the monoliths.

* * * * *